US005170727A

United States Patent [19]

Nielsen

[11] Patent Number: 5,170,727

[45] Date of Patent: Dec. 15, 1992

[54] SUPERCRITICAL FLUIDS AS DILUENTS IN COMBUSTION OF LIQUID FUELS AND WASTE MATERIALS

[75] Inventor: Kenneth A. Nielsen, Charleston, W. Va.

[73] Assignee: Union Carbide Chemicals & Plastics Technology Corporation, Danbury, Conn.

[21] Appl. No.: 677,104

[22] Filed: Mar. 29, 1991

[51] Int. Cl.[5] ..... F23G 7/04

[52] U.S. Cl. ..... 110/346; 110/238; 110/347; 431/2; 239/5

[58] Field of Search ..... 431/2; 110/347, 238, 110/346; 239/5

[56] References Cited

U.S. PATENT DOCUMENTS

| | | | |
|---|---|---|---|
| 3,393,564 | 7/1968 | Donnelly | 239/8 X |
| 4,124,526 | 11/1978 | Modell | 252/411 |
| 4,189,914 | 2/1980 | Marek et al. | 60/726 |
| 4,375,387 | 3/1983 | deFilippi et al. | 202/169 |
| 4,582,731 | 4/1986 | Smith | 427/421 |
| 4,619,735 | 10/1986 | Norton | 162/135 |
| 4,640,675 | 2/1987 | Green et al. | 431/2 |
| 4,734,227 | 3/1988 | Smith | 264/13 |
| 4,734,451 | 3/1988 | Smith | 524/493 |
| 4,737,384 | 4/1988 | Murthy et al. | 427/369 |
| 4,923,720 | 5/1990 | Lee | 427/422 |

FOREIGN PATENT DOCUMENTS

| | | | |
|---|---|---|---|
| 2603664 | 8/1977 | Fed. Rep. of Germany . | |
| 2853066 | 6/1980 | Fed. Rep. of Germany . | |
| 55-4328 | 6/1980 | Japan . | |
| 58-168674 | 10/1983 | Japan . | |
| 59-16703 | 1/1984 | Japan . | |
| 0095313 | 6/1984 | Japan | 431/2 |
| 62-152505 | 7/1987 | Japan . | |
| 868061 | 4/1988 | South Africa . | |

OTHER PUBLICATIONS

Francis, A. W., "Ternary Systems of Liquid Carbon Dioxide", J. Phys. Chem. 58:1099, Dec. 1954.

Smith, R. D., et al., "Direct Fluid Injection Interface for Capillary Supercritical Fluid Chromatography-Mass Spectrometry", J. Chromatog. 247(1982):231-243.

Krukonis, V., "Supercritical Fluid Nucleation of Difficult-to-Comminute Solids", paper presented at 1984 Annual Meeting, AIChE, San Francisco, Calif., Nov. 25-30, 1984.

McHugh, M. A., et al., "Supercritical Fluid Extraction, Principles and Practice", Butterworth Publishers (1986) Contents and Append.

Cobbs, W. et al., "High Solids Coatings Above 80% By Volume", Water-Borne & High Solids Coatings Symposium, Mar. 1980.

Matson, D. W. et al., "Production of Fine Powders by the Rapid Expansion of Supercritical Fluid Solutions", Advances in Ceramics vol. 21, pp. 109-121 (1987).

Kitamura, Y., et al., "Critical Superheat for Flashing of Superheated Liquid Jets", Ind. Eng. Chem. Fund. 25:206-211 (1986).

Petersen, R. C. et al., "The Formation of Polymer Fibers From the Rapid Expansion of SCF Solutions", Pol. Eng. & Sci. (1987), vol. 27, p. 16.

Dandage, D. K., et al., "Structure Solubility Correlations: Organic Compounds and Dense Carbon Dioxide Binary Systems", Ind. Eng. Chem. Prod. Res. Dev. 24:162-166 (1985).

Matson, D. W., et al., "Production of Powders and Films by the Rapid Expansion of Supercritical Solutions", J. Materials Science, 22:1919-1928 (1987).

*Primary Examiner*—Edward G. Favors

*Attorney, Agent, or Firm*—M. N. Reinisch

[57] ABSTRACT

The present invention is directed to processes and apparatus in which supercritical fluids are used as viscosity reduction diluents for liquid fuels or waste materials which are then spray atomized into a combustion chamber. The addition of supercritical fluid to the liquid fuel and/or waste material allows viscous petroleum fractions and other liquids such as viscous waste materials that are too viscous to be atomized (or to be atomized well) to now be atomized by this invention by achieving viscosity reduction and allowing the fuel to produce a combustible spray and improved combustion efficiency. Moreover, the present invention also allows liquid fuels that have suitable viscosities to be better utilized as a fuel by achieving further viscosity reduction that improves atomization still further by reducing droplet size which enhances evaporation of the fuel from the droplets.

19 Claims, 9 Drawing Sheets

SUPERCRITICAL FLUIDS AS DILUENTS IN COMBUSTION OF LIQUID FUELS AND WASTE MATERIALS

FIELD OF THE INVENTION

This invention relates generally to the combustion of fuels and waste materials. More particularly, the present invention pertains to methods and apparatus for improving combustion of fuels and waste materials by enabling the use of fuels which heretofore have not been able to effectively be atomized for proper combustion and/or by providing a more favorable atomized droplet size in conventional fuels which facilitates and enhances the combustion of such conventional fuels. These improvements are desirably obtained by the utilization of supercritical fluids as diluents with the fuels and waste materials.

BACKGROUND OF THE INVENTION

Liquid fuels generally do not burn as liquids but instead must first vaporize to a gas and mix with oxygen in order to sustain combustion. Accordingly, a liquid fuel must first be dispersed into air as fine droplets in order to provide a large surface area for evaporation and to promote intimate mixing with the oxygen in the air. The combustion or evaporation time of a 100 micron droplet, for example, is about 10 milliseconds. In contrast, a 10 micron droplet would evaporate completely in 1 millisecond, which is more desirable. Radiant heat transfer from the burning vapor helps to heat the droplets so that further evaporation occurs.

In order to provide the liquid fuel in the form of fine droplets, it is necessary for the fuels to be atomized. Liquid fuels are generally atomized by spraying the fuel into a combustion zone by various common atomization methods: 1) airblast atomizers, where a large volume of low-pressure air shatters a low-velocity jet or sheet of fuel into ligaments and then fine droplets; 2) airless or pressure atomizers, where pressurized fuel passes through a small orifice at high velocity into quiescent air to form a liquid jet, hollow cone, or sheet of fuel that breaks up into droplets from shear with the air, which normally produces larger droplet size than in airblast atomization; and 3) air-assist atomizers, where atomization is caused by both fuel pressurization and a low volume of high-velocity air and which may be considered a combination of (1) and (2) above. Atomization processes are discussed in Lefebvre, A. H., 1989, *Atomization and Liquid Sprays*, Hemisphere Publishing Company, N.Y.

All of these atomization methods require that the liquid fuel possess a low enough viscosity so that good atomization may occur to produce the fine droplet sizes needed for good vaporization which, in turn, produces good combustion. If the fuel viscosity is too high, atomization is poor, at best, resulting in larger than desired droplets having much less surface area. This produces poor and/or incomplete combustion.

In Beer, J. M., and Chigier, N. A., 1972, *Combustion Aerodynamics*, Applied Science Publishers, Limited, London, Chapter 6 entitled "Droplets and Sprays", it is noted that most practical liquid fuel sprays have a size distribution over a wide range of droplet sizes with a mean droplet size between about 75 to about 130 microns, with a maximum droplet size being preferably under 250 microns. Beer and Chigier disclose that the smallest droplets vaporize completely, but that in larger droplets formed from heavier fuels, that is, fuels having a high viscosity, liquid phase cracking occurs, which leads to the undesirable formation of carbonaceous residue, often in the form of a cenosphere.

For distillate fuels of moderate viscosity, such as about 30 centipoise at room temperature, simple pressure atomization with a spray nozzle at a pressure of about 100 to 150 pounds per square inch (psi) produces a droplet diameter distribution that ranges from about 10 to about 150 microns, with a midrange average of about 80 microns. With decreasing fuel pressure, atomization becomes progressively less satisfactory. Much higher pressures are often used to produce a higher velocity of the liquid fuel relative to the surrounding air, thereby producing smaller droplets and evaporation times.

However, conventional spray nozzles are relatively ineffective for atomizing fuels of high viscosity, such as No. 6 fuel oil, residual oil (Bunker C), and other viscous low-quality fuels. In order to transfer and pump No. 6 fuel oil, it must usually be heated to about 100° C., at which temperature its viscosity is still typically at least about 40 centipoise. Atomization of such fuels is often accomplished, or at least assisted, by atomizing air pumped at high velocity through adjacent passages in or around the liquid injection ports. Much of the relative velocity required to shear the liquid and form droplets is thus provided by the atomizing air; its mass flow is usually comparable with the fuel flow and thus comprises only a small fraction of the stoichiometric combustion air.

Accordingly, there is a need to have an improved method of atomizing liquid fuels so as to accomplish at least two objectives, namely, to facilitate the effective and economical use of higher viscosity fuels and, moreover, to obtain a more favorable droplet size and size distribution to provide more complete combustion and less by-product formation, not only in such higher viscosity fuels but also in moderate viscosity and low viscosity fuels as well.

Indeed, what is most desirable is a spray having a relatively narrow droplet size distribution with an average droplet diameter in the region of from about 10 to about 50 microns or lower so that the ratio of surface to volume of the burning droplet is the largest possible, thereby causing it to receive more heat and consequently burn faster. With droplets in this size range, nearly instantaneous evaporation occurs, even with many of the higher boiling fuel species present, which results in the substantial formation of a combustible vapor (gaseous) spray, wherein the vaporized fuel and oxygen are quickly mixed in stoichiometric quantities so that burning occurs rapidly and with only a small fraction of the droplets undergoing pyrolysis. This minimizes the formation of undesirable carbonaceous particles which would otherwise adhere to furnace surfaces and/or escape the combustion chamber into the environment unless additional means are taken to prevent such occurrence.

SUMMARY OF THE INVENTION

By virtue of the present invention, the above needs have now substantially been met. More particularly, in its broadest aspects, this invention is directed to processes and apparatus in which fluids in the supercritical state of temperature and pressure, such as, but not limited to, carbon dioxide, nitrous oxide, methane, ethane, propane, butane, or mixtures thereof, are used as viscosity reduction diluents and atomization agents for liquid fuels or waste materials which are spray atomized into a combustion zone or chamber. The addition of supercritical fluid to the liquid fuel and/or waste material allows viscous petroleum fractions and other liquids such as viscous waste materials that are too viscous to be atomized (or to be atomized well) at present to now be atomized by this invention, by achieving viscosity reduction and explosive decompressive atomization, which allows the fuel and/or waste material to produce a combustible spray and improved combustion efficiency. Moreover, the present invention also allows liquid fuels that have suitable viscosities to be better utilized as a fuel by achieving further viscosity reduction and more explosive atomization by a decompressive atomization mechanism, which improves the atomization process by reducing droplet size still further, which enhances evaporation of the fuel from the droplets, and by enhancing dispersion of the fuel droplets within the combustion zone.

The preatomized mixture will preferably be at or above the critical temperature and critical pressure of the diluent fluid such that the diluent will clearly be in the supercritical state and will not act as a vapor; that is to say, the diluent supercritical fluid by itself under the existing temperature condition will not be capable of liquefaction by the application of pressure alone. However, in the supercritical region, the gas has liquid-like characteristics, such as a density more similar to a liquid density rather than a typical gaseous density.

A fuel for combustion processes is a material used to produce heat and/or power by burning, that is, by exothermic reaction with oxygen such as from air. The main combustion products are usually carbon dioxide and water, but other materials such as sulfur dioxide, nitrogen oxides, carbon monoxide, unburned hydrocarbons, ash, and particulates such as carbonaceous particles and soot may be formed depending upon the composition of the fuel and the combustion conditions. An important factor is the ratio of oxygen to fuel, which needs to be at least as high as the stoichiometric ratio to ensure complete and efficient combustion of the fuel, as is known to those skilled in the art of combustion. Examples of liquid fuels that are suitable for use in the present invention include, but are not limited to, organic and hydrocarbon materials such as gasoline, kerosene, naptha, gas oils, heating oils, fuel oils, residual oils, and other petroleum products manufactured from crude petroleum, including heavy oil, by separation and/or reaction processes, such as distillation and cracking, which separate the petroleum into various fractions and convert higher molecular weight components into lower molecular weight components that are more readily burned. The present invention also applies to lower grade liquid fuels and synthetic fuels derived from coal, shale oil, bituminous sands, tar sands, biomass, and the like by various liquefaction processes. Still further, the present invention is also directed to the incineration or combustion of waste matter, such as hazardous wastes, which may comprise organic solids and liquids ranging from low boiling materials to gummy organics with suspended solids, dry solids combustibles, wet sludges, and hazardous liquids. Such wastes include liquid organic wastes from chemical plants or other chemical processing operations, such as hazardous waste chemicals, solvents, liquid polymers and polymer solutions, dispersions, and emulsions, chemical reaction byproducts, and distillation column waste streams such as distillation bottoms; from petroleum refining operations, such as waste petroleum products, residues from distillation columns, and unrefined byproducts; from manufacturing operations, such as spent solvents and lubricants; from food processing operations, such as spent cooking oils and processing oils; from coating operations, such as waste paints and coatings and spent cleaning solvents; from printing operations, such as spent inks and cleaning solvents; and the like. Accordingly, as used herein, a liquid fuel may comprise all of these materials, alone or in combination, provided that it is in a form which when combined with the supercritical fluid is able to be sprayed and form the desired droplet sizes. In the case of dry solids combustibles, for example, it is understood, of course, that this would necessitate the addition of suitable solvents and the like so as to enable such material to be in a liquid form when subsequently combined with the supercritical fluid.

Accordingly, as a result of the present invention, viscous fuels, such as represented by No. 6 fuel oil, can now be reduced in viscosity at relatively low temperatures such that, with atomization under supercritical conditions of both pressure and temperature, better atomization occurs, resulting in smaller droplet sizes and size distributions producing more complete and cleaner combustion. Thus, for No. 6 fuel oil, the fuel needs to be heated only to about 30° to 35° C. to lower its viscosity to the pumpable range of about 1000 to 2000 centipoise. This temperature is just about the critical temperature of added supercritical fluid diluents such as ethane and carbon dioxide, for example, wherein after pressurization to the critical pressure region for such diluents, which is within the pressure range normally used with pressure atomizers, the single-phase admixture viscosity now becomes less than 30 centipoise. This allows for effective atomization, thereby resulting in efficient combustion. This is in contrast to conventional atomization and combustion of No. 6 fuel oil, wherein the oil must be heated to temperatures in excess of about 120° C. In addition to viscosity reduction, the supercritical fluid can produce decompressive atomization by a different atomization mechanism, which results in more explosive atomization than occurs with conventional pressure atomization techniques.

Furthermore, fuels with moderate viscosity or even relatively low viscosity can attain an even lower viscosity when admixed with one or more supercritical fluids. The subsequent decompressive spraying of such a reduced viscosity liquid admixture produces even smaller droplet sizes than would otherwise be obtained. The formation of even smaller droplet sizes (droplet sizes approaching the one micron diameter range are possible) results in enhanced vaporization of the fuel from the droplets and, therefore, also enhances its ultimate combustion. The ability to provide such small droplet sizes by means of the present invention approaches the most ideal and desirable premixed flammable gas mixture combustion state, wherein the most efficient combustion occurs with the lowest production of carbonaceous particles, which is presently unknown in conventional liquid fuel combustion processes.

Accordingly, in its broadest embodiment, the present invention is directed to a process for forming a combustible liquid spray mixture which comprises:

a) forming a liquid mixture in a closed system, said liquid mixture comprising:
   (i) at least one liquid fuel capable of being combusted; and
   (ii) at least one supercritical fluid which is at least partially miscible with the liquid fuel; and
b) spraying said liquid mixture into an atmosphere capable of sustaining combustion of said liquid fuel.

In another embodiment, the present invention is directed to a process for forming a combustible liquid spray mixture which comprises:

a) forming a liquid mixture in a closed system, said liquid mixture comprising:
   (i) at least one liquid fuel capable of being combusted; and
   (ii) at least one supercritical fluid which is at least partially miscible with the liquid fuel; and
b) spraying said liquid mixture as a decompressive spray into an atmosphere capable of sustaining combustion of said liquid fuel.

The invention is also directed to a liquid spray combustion process comprised of mixing at least one solid particulate fuel with the liquid fuel, the supercritical fluid diluent, and optionally organic solvent, to form a suspension of solid fuel in liquid fuel prior to spraying the liquid-solid mixture for combustion. For example, the solid fuel can be powdered coal that is mixed into a petroleum fraction, or a solid waste. In other instances, the solid particulate fuel may become completely or partially miscible with the supercritical fluid under supercritical conditions. The liquid fuel forms a continuous phase and hence the terms "liquid fuel" and "liquid mixture" and "liquid spray" shall be understood to also include a continuous liquid phase with at least one dispersed solid phase.

It is also to be understood that other materials may be added to modify the combustion properties of the fuel, either dissolved or as a mixture of liquid or gas, such as water, oxygen, air, or other conventional combustion additives.

Also in its broadest embodiment, the present invention is directed to an apparatus for the spray combustion of liquid fuels containing at least one supercritical fluid comprising, in combination:

a) means for supplying at least one liquid fuel capable of being combusted;
b) means for supplying at least one supercritical fluid;
c) means for forming a liquid mixture of the components supplied by means (a) and (b); and
d) means for spraying said liquid mixture by passing the mixture under pressure through an orifice into an atmosphere capable of sustaining combustion.

In a more preferred embodiment, the apparatus comprises means, such as a combustor, which define a combustion chamber; means, preferably a high pressure pump, for supplying at least one pressurized fuel at a pressure above the critical pressure of a supplied diluent; means, preferably a second high pressure pump, for supplying at least one pressurized supercritical fluid diluent at a pressure above the critical pressure thereof and in an amount which when added is sufficient to render the viscosity of the mixture of fuel and supercritical fluid diluent to a point suitable for spray combustion; a supercritical mixing chamber for mixing said pressurized fuel and supercritical fluid diluent to produce fuel/supercritical fluid diluent liquid mixture; means for heating the fuel/supercritical fluid diluent liquid mixture prior to atomization to above, at, or just below the critical temperature of the supercritical fluid diluent; and means, such as a spray nozzle or nozzles, for supplying the fuel/supercritical fluid diluent liquid mixture from said mixing chamber to the combustion space, which is preferably at or near atmospheric pressure for combustion therein.

The present invention is related to the use of supercritical fluid diluents which are disclosed in U.S. Pat. No. 4,923,720, issued May 8, 1990; U.S. patent application Ser. No. 218,910, filed Jul. 14, 1988; U.S. patent application Ser. No. 327,273, filed Mar. 22, 1989; U.S. patent application Ser. No. 327,275, filed Mar. 22, 1989; and U.S. patent application Ser. No. 327,484, filed Mar. 22, 1989, wherein, among other things, the utilization of supercritical fluids, such as supercritical carbon dioxide, as diluents in highly viscous organic solvent-borne and/or highly viscous non-aqueous dispersion coating compositions is taught to dilute these compositions to the application viscosity required for liquid spray techniques.

The utilization of supercritical fluids in industry is well documented, see Supercritical Fluids, pages 872–891 in Grayson, M., editor, 1984, *Kirk-Othmer Encyclopedia of Chemical Technology*, Third Edition, Supplement Volume, Wiley-Interscience, New York. The concept of solubility enhancement was first recognized in the late 1800's when potassium iodide was dissolved in supercritical ethanol and then precipitated upon reduction in the pressure to the subcritical pressure regime of ethanol. The effect of supercritical water in geological processes upon rock formation was the next development, followed by that of methane in the formation and migration of petroleum. In the early 1940's the first practical use of supercritical fluid extraction was proposed in relation to the deasphalting of petroleum oils. Supercritical methane was used in the separation of crude oil, extraction of lanolin from wool grease, and extraction of ozocerite wax from ores. The application of supercritical extraction competes with such technologies as liquid solvent extraction and distillation. In the area of natural materials are included supercritical fluid extraction of unwanted substances such as caffeine and nicotine and the separation of constituents such as food essences and drugs. For fossil fuels, application of supercritical fluid extraction include enhanced oil recovery, extraction of liquids from coal, and fractionation of heavy petroleum liquids.

For food and pharmaceutical applications, supercritical carbon dioxide is the most prominent supercritical fluid utilized. In addition to aforementioned extractions in decaffeination and denicotinization processes, other processes include acids from hops, extraction of oils from soybean flake and corn germ in which, in addition to carbon dioxide, ethane, propane, and nitrous oxide are used.

Supercritical fluid extraction utilized in synthetic fuels application include coal processing such as solvent coal extraction, coal liquefaction, extraction of carbonaceous residua, and an integrated process of producing methanol from coal followed by conversion to gasoline. These processes use supercritical fluids such as normal paraffins, olefins, halogenated light hydrocarbons, carbon dioxide, ammonia, sulfur dioxide, toluene and other similar aromatics, bicyclic aromatic and naphthenic hydrocarbons, alcohols, aldehydes, ketones, esters and amines, and they are usually carried out above the critical temperature and pressure of the solvent. U.S. Def. Pub. Ser. No. 700,485, and U.S. Pat. Nos. 3,558,468, 4,192.731, 4,251,346, 4,376,693, 4,388,171, 4,402,821, 4,443.321, 4,447,310, 4,508,597, and 4,675,101 are some examples which disclose processes wherein coal is contacted with one or more of the aforementioned solvents under supercritical conditions until significant portions are dissolved in the solvent, then easily removed from residual solid materials, usually by filtration, and then the filtrate is separated by distillation into a solvent fraction for recycle and a liquid fossil fuel, which may be used directly as a fuel or further refined to yield a variety of hydrocarbon products, including diesel and jet fuels. Which purpose of the art is primarily obtaining other useful fuels from coal.

Likewise, supercritical fluid extraction is used to derive sources of fuel from tar sands, lignite, wood, and oil shale, using solvents from the same classes aforementioned in the liquefaction and extraction of coal. U.S. Def. Pub. Ser. No. 700,489 and U.S. Pat. Nos. 4,108,760 and 4,341,619 are some examples in which such means are disclosed.

Petroleum applications include converting feedstocks such as atmospheric and vacuum-distillation residues to cat-cracker and lubricating-oil feedstocks using lower boiling paraffins in supercritical fluid extraction processes to effect upgrading with process stages which may include cracking and hydroconversion. U.S. Pat. Nos. 4,354,922, 4,406,778, 4,532,992, and 4,547,292 are some examples that disclose such processes. In addition to the above, supercritical fluid injection has been tested for tertiary oil recovery from petroleum reservoirs. This method is particularly suitable for the use of relatively inexpensive carbon dioxide.

An improvement in atomization technology is disclosed by Martynyuk; Soviet Union Patent No. 1,242,250, dated Jul. 7, 1986, wherein a liquid fuel, such as kerosene, is heated to 0.9–1.2 of its critical temperature and then extruded through a nozzle at a pressure equal to 1.0–3.0 of its critical pressure. When this method is practiced at or above the critical point of the material, said material is no longer a liquid, but is by definition a gas, and therefore issues from the nozzle as a gas jet rather than as a liquid sheet or filament that eventually forms a spray. The advantage cited for atomizing undiluted liquid fuels is an increased dispersion of the spray by two orders of magnitude, compared to conventional atomizers, which results in more complete combustion and reduced pollution byproducts of incomplete combustion. While perhaps useful with low viscosity easily vaporized fluids such as kerosene, use with higher viscosity fuels would clearly not be advantageous. With a fluid such as No. 6 fuel oil, for example, temperatures in excess of about 500° C. would have to be reached to achieve the prescribed critical temperature state. Attaining this level of temperature without encountering unwanted chemical reactions such as polymerization, oxidation, nitration, rapid decomposition, etc., is highly unlikely. Such reactions result in the generation of byproduct residues and particulate matter, and the like, that would affect the performance of an atomizer and also contribute to the potential for pollution due to incomplete combustion. Even No. 2 fuel oil would experience some of these undesirable reactions when heated above its critical temperature.

The supercritical combustion of liquid fuels in droplet form has also been investigated because, in part, operating pressures in combustors that use fuel sprays are exceeding the critical pressures of frequently used fuels. See Kadota and Hiroyasu, 1981, *Eighteenth Symposium (International) on Combustion*. The Combustion Institute, pages 275–282, wherein the results of a study of the combustion of single droplets of fuels suspended in gaseous environments under supercritical conditions, with the measurement of droplet temperatures, combustion lifetimes, and burning rate constants are reported. These results show that the final droplet temperature is nearly at its critical temperature; the combustion lifetime correlated well with the reduced pressure of the fuel; and, when in a pressure range between a reduced pressure of 0.3 and 1.0, the combustion lifetime decreased abruptly with increasing pressure, with a further increase in pressure resulting in a slight decrease in the combustion lifetime. Allen, in U.S. Pat. No. 2,866,693, issued Dec. 30, 1958, discloses such supercritical pressure combustion, wherein diesel fuel mixed with a low boiling paraffin, such as propane or butane or a mixture thereof, is blended in an amount sufficient to raise the critical pressure of the mixture to at least the compression pressure of the engine.

At compression pressure conditions of 700 psi, Allen found the addition of about 4 to 28 percent by volume of a paraffin to the diesel fuel to be effective. According to Allen, what was discovered was a fuel mixture that expanded the narrow phase envelope of pure diesel fuel, which does not include the pressure and temperature existing in the engine at the time of injection, such that the boundaries of the phase envelope within which the fuel exists in two phases (in both the liquid phase and gas phase simultaneously) is increased so that pressures and temperatures normally existing in the cylinder of a diesel engine prior to ignition are included therein. And the fuel containing propane, butane, or mixtures thereof, when formed into the two-phase admixture, is substantially vaporized early in the cycle prior to combustion with the result that excellent mixing of fuel and air is realized. It appears, from the teachings of Allen, that the hypothesis is to enhance vaporization through spraying (injecting) a liquid-gas two-phase mixture into the combustion chamber under supercritical conditions within the cylinder of the diesel engine. That is different, of course, from conventional burners and furnaces that operate at or near atmospheric pressure, which is well under the critical pressure of fuel systems.

In addition to the use discussed above—the utilization of low boiling paraffins as a diluent for diesel fuels wherein combustion occurs at high pressure—other examples are well known to those skilled in the art. For example, U.S. Pat. No. 2,327,835, issued Aug. 24, 1943, discloses a fuel for a liquefied gas dispensing system wherein gasoline is added to propane to form a mixture designated to operate at materially lower vapor pressures than that of propane, and that such mixtures would be used in delivery systems for combustion for cooking, heating and refrigeration in rural communities, and the like. In another example, Jorden, et al., in U.S. Pat. No. 3,009,789, issued Nov. 21, 1961, discloses a gasoline fuel composition that is primed with propane and pentane to produce a balanced volatility to minimize vapor loss while maintaining a substantially constant vapor lock tendency rating. It is a well known that "gasoline" is a blend of various hydrocarbons, including the light hydrocarbons, to adjust and control Reid vapor pressure and front end volatility, and that the concentration of such components are adjusted seasonally.

The improvements disclosed in these examples relate to the diluent affecting the volatility characteristics of these fuels as this characteristic pertains to the standard conditions of temperature and pressure existing in burners, internal combustion engines, and the like, rather than primarily to atomization characteristics.

Marek, et al., in U.S. Pat. No. 4,189,914, issued Feb, 26, 1980, disclose a fuel injection apparatus for gas turbines, or the like, which includes a pair of high pressure pumps which provide fuel and a carrier fluid, such as air, at pressures above the critical pressure of the fuel. The carrier fluid and fuel, both at a pressure greater than the critical pressure of the fuel, but apparently at ambient temperature, are provided to a mixing chamber wherein the mixture is formed, and is then introduced into the combustion chamber. It is taught that the use of fuel and a carrier fluid at the supercritical pressure of the fuel promotes rapid mixing in the combustion chamber of the fuel-carrier fluid mixture with the combustion air so as to reduce the formation of pollutants and promote cleaner burning. The illustration of the art disclosed therein cites the mixing of "Jet A" fuel with air as a carrier with both at pressures exceeding the stated critical pressure of the precursor fuel of 18 atmospheres, but presumably only by some small incremental amount. Also, presumably with both the fuel and air at temperatures that are considerably below the critical temperature of the fuel, and also with apparently neither the fuel nor the air near, at, or above the critical pressure of air of 37.2 atmospheres; however, the carrier air is above its critical temperature of −140.7° C. Under such conditions, thermodynamic principles predict that the fuel-carrier fluid mixture so formed comprises a normally undesirable gas-liquid two-phase mixture of liquid fuel and gaseous air, which is contrary to the teachings of Marek, et al., "that a single-phase is formed." Based on thermodynamics, to achieve a single-phase mixture for his system, either the pressure or the temperature, or a combination thereof, would have to be increased such that the state of the mixture is changed so that it resides outside of the two-phase envelope of said mixture, which includes the critical point of the mixture formed, or such that it is below that of the bubble point curve of said mixture. Theoretically, therefore, 1) to attain at ambient temperature the desirable single-phase state of a mixture consisting predominantly of "Jet-A" fuel, it would appear to require a pressure much greater than the critical pressure of the carrier air because the "binary critical curve" that connects the critical points of the two entities has a locus of pressures greater than either entity, or 2) with the pressure approaching the critical pressure of "Jet-A" fuel, the temperature would have to be about −100° C. Even at these extremes, appreciable solubility of the air in the fuel is unlikely. Each of these conditions would seem to be an unattractive compromise to the expressed art.

Another example of combustion under supercritical conditions is disclosed in U.S. Pat. No. 4,338,199, issued Jul. 6, 1982, and U.S. Pat. No. 4,543,190, issued Sep. 24, 1985, wherein various organic materials including fuels, toxics, and wastes such as, for example, coal, fir bark, wood, bagasse, raw sewage, bovine waste, rice hulls, paper mill sludge, sewage sludge, ethanol, carbon, hexane, benzene, fuel oil, Aldrin, DDT, Lindane, Malathion, p-aminobenzoic acid, Heptachlor, nitrosamines, commuted paper waste, landfill garbage, seawater, sulphur-containing fuels, halogen-containing organics, and the like, are admixed with water and oxygen, or a fluid comprising oxygen. The mixture is raised in temperature and pressure to an oxidation temperature of at least 377° C., at a pressure of at least 220 atmospheres, which is the supercritical conditions for water, and reacted as a single fluid phase in a well insulated reactor. The reactor is characterized as a flow-through oxidizer such as an insulated stainless steel tube or as a fluidized bed. The undergoing reactions cause the organic material to be oxidized wherein the effluent stream picks up the heat generated, thereby obtaining useful energy for use in power generation and/or in providing process heat. It is claimed that this process is useful in destroying waste or toxic material, burning dirty fuels, desalination, and recovering useful energy. In all cases cited, oxidation is carried out in the presence of water and at or above the exceedingly high levels of temperature and pressure associated with such critical levels for water, which consumes considerable energy in so effecting the process. Although as illustrated there are several cases when such might be the preferred process.

Unlike the foregoing processes, solid and liquid waste incineration, including hazardous wastes, is representative of a process wherein such wastes are burned in combustion chambers near or at atmospheric pressure using conventional combustion apparatus such as burners and atomizers, for example, for liquid wastes. Because of the nature of the process, higher temperatures normally are required to completely destroy contained hazardous materials. Such incinerators include the following types: liquid injection, fixed hearth, inclined rotary, fluidized bed, multiple hearth, pulse hearth, rotary hearth, reciprocating hearth, and infrared, with the liquid injection system predominating.

In liquid injection, the waste liquids, normally organic-bearing wastes, are fed to the combustion chamber singly or, if compatible, blended with other wastes before injection. When large quantities of aqueous waste are burned, a high velocity gas or liquid supplementary fuel burner is usually used in the combustion chamber, normally located on the side of the chamber. With viscous waste fluids all of the aforementioned difficulties associated with atomizing and burning such fluids prevail. In addition, in the burning of waste, it is singularly important to consider other design parameters such as temperature, residence time, and flow pattern. As with conventional fluids, improved atomization leading to smaller liquid droplets and narrow droplet distribution would help reduce atomization costs while enhancing the complete destruction of the hazardous chemicals through more efficient combustion.

The incineration of solid industrial wastes is usually carried out in the fixed or multiple hearth and the rotary types. In these types, solid waste or sludges are introduced into the combustion zone and generally travel countercurrent to the combustion air and flue gases. Auxiliary liquid or gas fuel is usually supplied to burners for start-up or to sustain difficultly oxidized wastes. These units are normally large and expensive to construct and operate. If these solid wastes could inexpensively be partially or completely dissolved in fluid(s) suitable for burning through liquid injection and atomization into the chamber of a liquid incinerator, cost and pollution reduction could result.

Because of the nature of the components in these liquid and solid wastes and their combustion products, corrosion-resistant materials of construction are required, and auxiliary equipment is often necessary and is generally so provided in these incinerators. Such equipment includes afterburners, pollution control scrubbers, venturi scrubbers, irrigated fiber beds, wet electrostatic precipitators, and the like, and they are expensive to construct and operate. This art would benefit from improved atomization, and especially benefit from enhancement in the solubilization of solid components that may be present in such wastes.

Pulverized coal is widely used as a fuel for boilers and furnaces. Also, engines, such as diesel and gas turbine types, have been designed and tested for using pulverized coal, but have not yet achieved commercialization. As a result of increased fuel consumption there has been an interest in such a use of coal because of the existence of large reserves, particularly with the decreasing supply of oil and its increasing cost and the estimated continued escalation of same. Problems associated with using coal are the cost of delivery and handling and of crushing equipment. The use of a liquid slurry of pulverized coal in water or a petroleum-based carrier for transportation, storage, and distribution would be useful. Such facilities for pulverizing, preparing, and treating coal-water slurry to achieve desirable liquid, storage, and combustion properties is advancing, with the most immediate application being the conversion of oil and gas boilers and furnaces to coal slurry fuel.

Two main problems associated with the combustion of coal-water mixture fuels are delayed ignition, due to the energy needed to evaporate the water, and the agglomeration of small coal particles into larger particles during the combustion process In this process, the coal is generally pulverized to particles of an average diameter of about 40–50 microns, but some as low as 10–20 microns have been reported. After being slurried with water to the desired mixture of about 60 to 70 percent coal, the viscosity, at 38° C., is about 630 centipoise, which is relatively high for good atomization.

Coal-oil slurries are useful in reducing the amount of fuel oil being fired. These coal-oil mixtures (COM) can be used in conventional furnaces and boilers, with only a minimum of modification. In many cases the mixture of interest is pulverized coal and No. 6 Fuel Oil. Mixtures of 40 to 50 percent coal are of most interest, in which coal pulverized to less than 3 mm in diameter is wet ground at about 90° C. with the fuel oil to an average particle diameter of about 75 microns, with a viscosity, at 50° C., of about 8000 centipoise; the fuel oil alone typically has a viscosity of over 500 centipoise at this temperature. In most processes, the COM is pumped for storage, at 80° C., through a heater where the temperature is raised to about 110° C., and then atomized using a steam or airblast atomizer, wherein steam or compressed air provides the energy of atomization. The steam or air pressures may range from about 20 to 200 pounds per square inch gauge (psig); with, for example, atomizing air at 40 psig when combined with the COM supplied at about 85 psig results in a burner tip pressure of about 30 psig. At this low pressure poor atomization is generally experienced. Experience with this kind of solid-liquid two-phase fluid of high viscosity has shown that 1) it causes fast wearing out of nozzles by abrasion, 2) the nozzle may be plugged by solid particles and fibers in the coal slurry, and 3) separation, sedimentation, and caking of the coal powder may occur as it flows through the nozzle or orifice. However, it is claimed the COM burns about as well as straight fuel oil. Although design changes are made to minimize these effects, costs are increased. Such technology would benefit from reduced viscosity and reduced spray droplet size, thereby improving atomization, as is possible with the processes of the present invention.

In the foregoing prior art, the supercritical fluid is utilized as an extractant and not as a viscosity reducing diluent. In all of the above, liquid fuels are produced either directly or after further processing that generally separates the supercritical fluids from the extracted fuel, whereafter said liquids may then be used as fuels in combustion processes, and as such contain no appreciable amount of the supercritical fluid. In such combustion processes, the fuel may be of a relatively high viscosity and application of the present invention would be beneficial in reducing further the viscosity such that the sprayed and atomized fuel-supercritical fluid mixture produces droplets of smaller diameter, which enhances combustion concurrent with minimal formation of carbonaceous solid particles.

Likewise, in complete contrast to the prior art per Marek, et al., in U.S. Pat. No. 4,189,914, wherein the fuel and carrier fluid such as air, which does not dissolve into the fuel in any appreciable amount, are supplied and admixed at the critical pressure of the carrier fluid in a mixing chamber at near or ambient temperature and as such is supplied to the combustion chamber, the present invention is directed to the use of a supercritical fluid diluent to form an admixture with the fuel that is above the critical pressure and the critical temperature of the diluent fluid, which in the usual case is above the critical pressure of the fuel being burned, and which has appreciable solubility in the fuel. This fluid is not being used as a carrier or as a fluid that assists atomization such as air in airblast or steam in steam assisted atomization, but rather as a viscosity reducing diluent to enable the use of unconventional fuels that typically would first have to be refined to higher grades, or with conventional fuels that display poor spraying performance, which in both cases effective spraying in the combustion chamber is accomplished. In contrast to the Marek, et al., process, the admixtures formed from such fuels and these supercritical fluid diluents, when raised, in the practice of this invention, to the critical pressure and temperature level of said diluents, will typically form a single-phase mixture, and as such achieve the objective of the present invention of effectively being sprayed into a combustion chamber, wherein efficient combustion is effected.

Moreover, the prior art does not disclose, in contrast to the present invention, the use of the added fluid as a diluent for the express purpose of reducing viscosity and/or for the solubilization of the liquid fuel, or its components, for the purpose of improving atomization and, thereby, providing more complete and cleaner combustion under near atmospheric pressure.

DETAILED DESCRIPTION OF THE INVENTION

Figure 1:
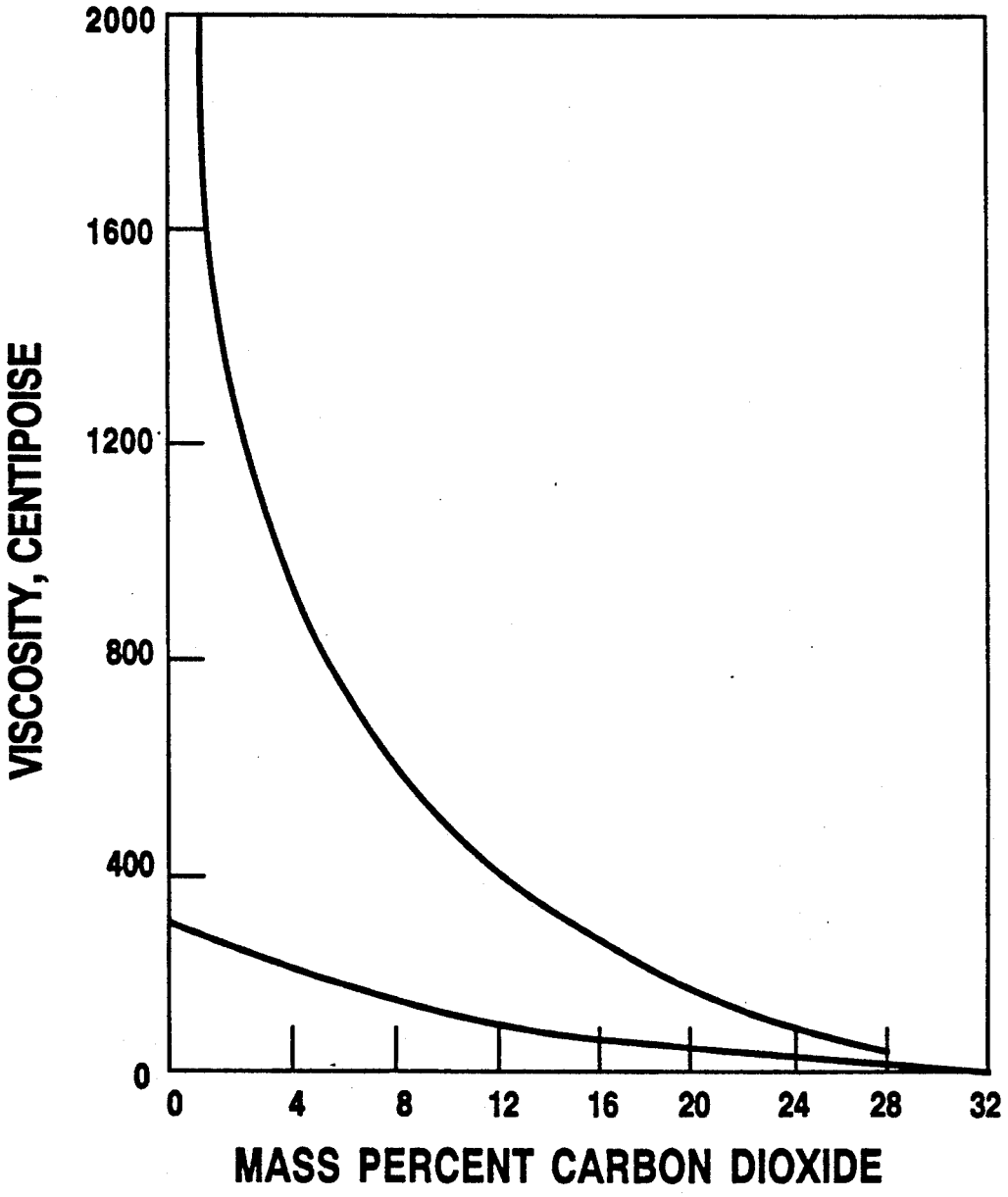
FIG. 1 is a diagram showing the effect of supercritical carbon dioxide dissolved in two viscous organic polymer mixtures upon the viscosities of said mixtures.
Figure 2A:
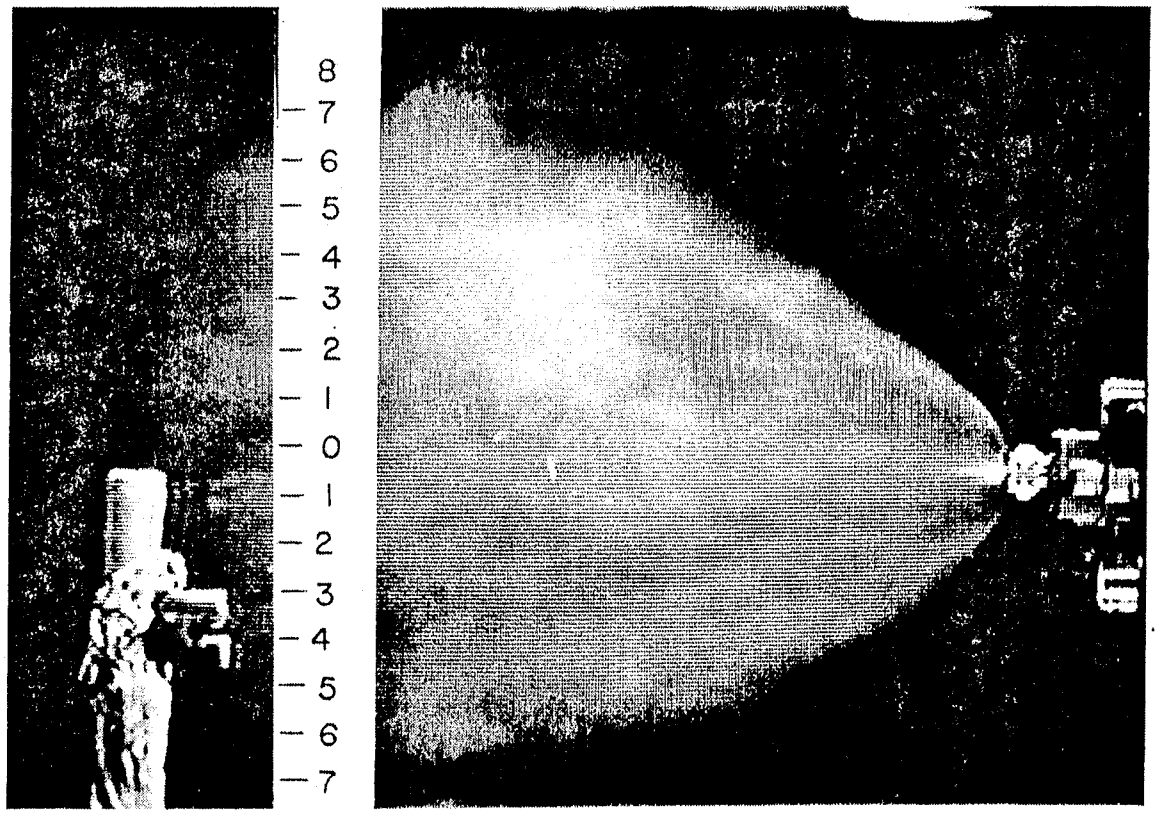
FIGS. 2*a*–2*c* are photoreproductions of actual atomized liquid sprays containing a decompressive spray pattern produced by dissolved supercritical carbon dioxide in accordance with the present invention.
Figure 2B:
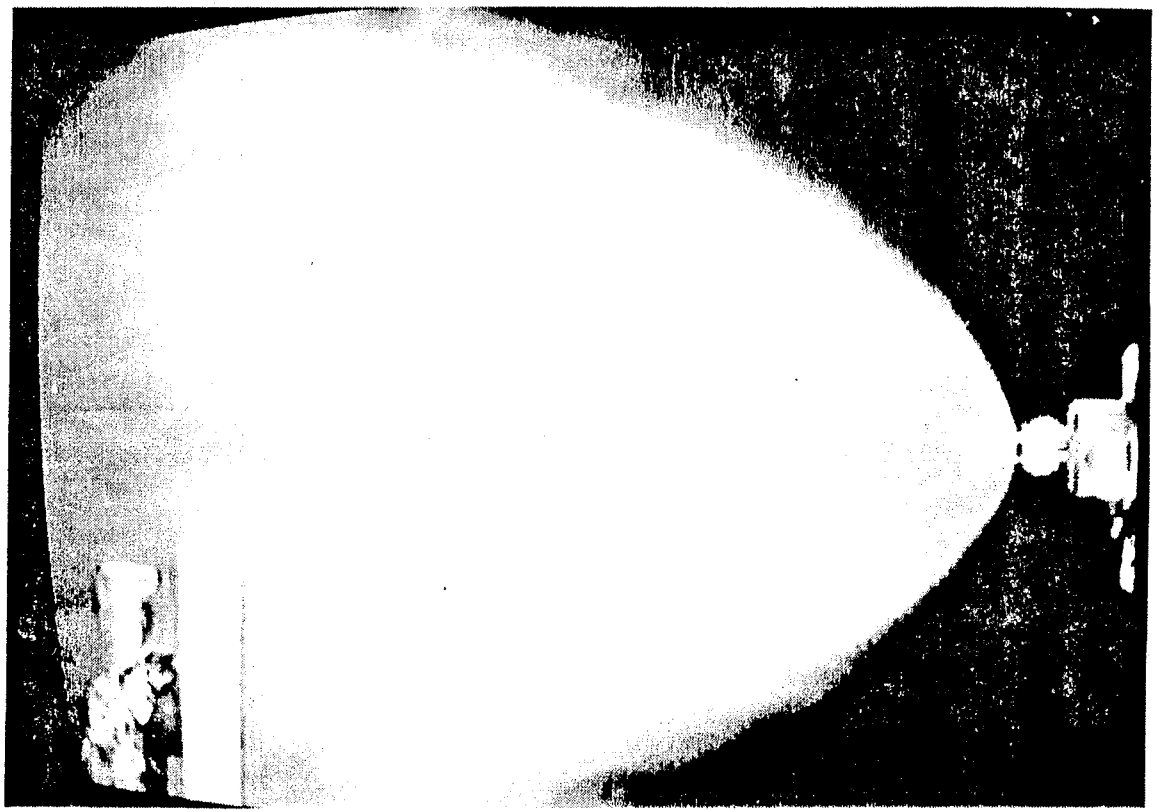
Figure 2C:
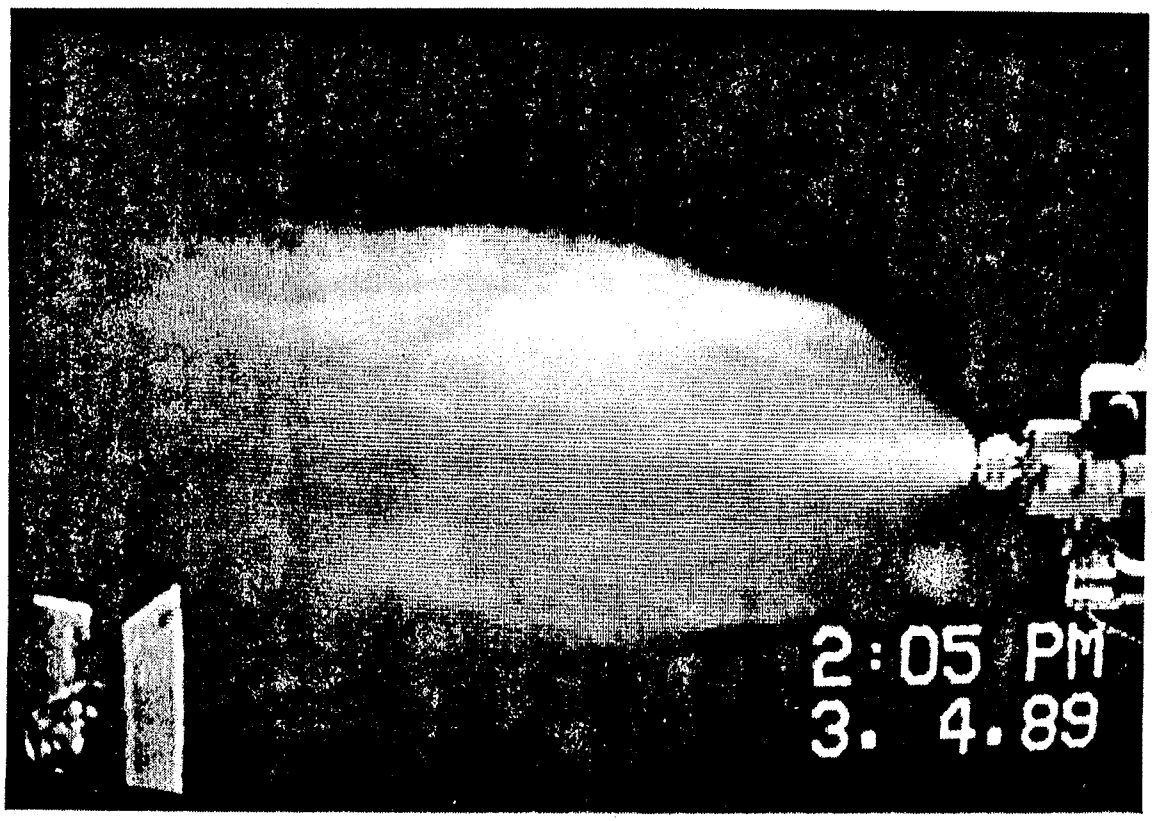

By using the processes and apparatus of the present invention, liquid fuels and other fuels and waste materials can be better atomized and sprayed under the supercritical conditions of the viscosity reducing diluent, to obtain more favorable spray properties for vaporizing the fuel and mixing it with air, and hence oxygen, for improved combustion at pressures that are preferably near or at atmospheric pressure.

Because of its relevancy to the present invention, a brief discussion of supercritical fluid phenomena is believed to be warranted. Supercritical fluid phenomenon is well documented, see pages F-62 to F-64 of the CRC Handbook of Chemistry and Physics, 67th Edition, 1986–1987, published by CRC Press, Boca Raton, Fla. At high pressures above the critical point, the resulting supercritical fluid, or "dense gas", will attain densities approaching those of a liquid. These properties are dependent upon the fluid composition, temperature, and pressure. As used herein, the "critical point" is the transition point at which the liquid and gaseous states of a substance merge into each other and become identical and represents the combination of the critical temperature and critical pressure for a given substance. The "critical temperature", as used herein, is defined as the temperature above which a gas cannot be liquefied by an increase in pressure. The "critical pressure", as used herein, is defined as the pressure which is just sufficient to cause the appearance of two phases at the critical temperature.

The compressibility of supercritical fluids is great just above the critical temperature, where small changes in pressure result in large changes in the density of the supercritical fluid. The "liquid-like" behavior of a supercritical fluid at higher pressures can result in greatly enhanced solubilizing capabilities compared to those of the "subcritical" compound, with higher diffusion coefficients, lower viscosities, surface tensions approaching zero, and an extended useful temperature range compared to liquids.

Near-supercritical liquids and vapors also demonstrate solubility characteristics and other pertinent properties such as high compressibility similar to those of supercritical fluids. The solute may be a liquid at the supercritical temperatures, even though it is a solid at lower temperatures. In addition, it has been demonstrated that fluid "modifiers" can often alter supercritical fluid properties significantly, even in relatively low concentration, greatly increasing solubility for some solutes. These variations are considered to be within the concept of a supercritical fluid as used in the context of this invention. Therefore, as used herein, the phrase "supercritical fluid" denotes a compound above, at, or somewhat below the critical temperature and pressure (the critical point) of that compound. Spray conditions below the critical temperature and/or pressure of the supercritical fluid diluent wherein the spray mixture is sufficiently compressible to produce a decompressive spray (discussed later) are considered to be within the context of this invention. Examples of compounds which are known to have utility as supercritical fluids and which have critical temperatures below 200° C. include: carbon dioxide, nitrous oxide, sulfur dioxide, ammonia, methyl amines, xenon, krypton, methane, ethane, ethylene, propane, propylene, butane, butene, pentane, dimethyl ether, methyl ethyl ether, diethyl ether, formaldehyde, chlorotrifluoromethane, monofluoromethane, methyl chloride, and cyclopentane.

As aforementioned, supercritical fluids have been found to be effective viscosity reducers in spray application of organic polymeric coatings such as lacquers, enamels, and varnishes. FIG. 1 shows viscosity reductions achieved by using supercritical carbon dioxide dissolved into two viscous organic polymeric compositions that are combustible and could be used as fuels or could be hazardous waste materials, which are typical of the systems included in the present invention. The figure shows viscosity reductions that occur at a spray temperature of 50° C. as the weight percent of dissolved supercritical carbon dioxide in the spray mixture is increased. The upper curve is for a very viscous composition that has a viscosity of 10,300 centipoise at room temperature. Heating it to 50° C. reduces the viscosity to 2000 centipoise. Adding dissolved supercritical carbon dioxide to 28 weight percent reduces the viscosity to a sprayable level that is below 40 centipoise. The lower curve is for a less viscous composition that has a viscosity of 940 centipoise at room temperature. Heating it to a temperature of 50° C. reduces the viscosity to 300 centipoise. Adding dissolved supercritical carbon dioxide to 28 weight percent reduces the viscosity to a sprayable level that is below 30 centipoise. Both compositions were sprayed at a pressure of about 1600 psig and produced sprays of finely atomized droplets suitable for combustion. With compositions having still lower viscosity, very low spray viscosities down to about one centipoise or less can be obtained, which produce very finely atomized sprays.

The supercritical fluid is preferably present in amounts ranging from about 10 to about 60 weight percent, based upon the total weight of the spray mixture formed by the admixture of supercritical fluid and liquid fuel or waste material. Most preferably, it is present in amounts ranging from about 20 to about 60 weight percent. The amount used depends upon the spray temperature and pressure chosen and on the particular properties of the liquid fuel or waste material, such as solubility, viscosity, and amount of dispersed solid materials, if any, that are present.

The dissolved supercritical fluid should be present in such amounts that a liquid spray mixture is formed that possesses a sufficiently low viscosity such that it can be readily sprayed. Generally, this requires the spray mixture to have a viscosity of less than about 300 centipoise at the spray temperature. Preferably, the viscosity is less than about 100 centipoise. More preferably, the viscosity is less than about 50 centipoise. Most preferably, the viscosity of the spray mixture is less than about 25 centipoise at the spray temperature, to achieve the finest atomization.

As disclosed by Hoy, et al., in U.S. patent application Ser. No. 327,273, and Nielsen in U.S. patent application Ser. No. 327,275, dissolved supercritical fluids have been found to do more than just reduce the viscosity of viscous compositions to a level suitable for spraying. Supercritical fluids have also been found to modify the shape, width, and other atomization characteristics of pressurized airless sprays. It has been discovered that supercritical fluids can produce explosive decompressive atomization by a new airless spray atomization mechanism. This greatly improves the airless spray process so that high quality atomization of liquid fuels and waste materials can be obtained and which promotes effective combustion of said materials.

Airless or pressure spray techniques use a high pressure drop across a spray orifice to propel the liquid fuel, waste material, or other material through the orifice at high velocity. The conventional atomization mechanism is well known and is discussed and illustrated by Dombroski, N., and Johns, W. R., 1963, *Chemical Engineering Science* 18:203. The liquid material exits the orifice as a liquid film or jet that becomes unstable from shear induced by its high velocity relative to the surrounding atmosphere. Waves grow in the liquid film or jet, become unstable, and break up into liquid filaments that likewise become unstable and break up into droplets. Atomization occurs because cohesion and surface tension forces, which hold the liquid together, are overcome by shear and fluid inertia forces, which break it apart. As used herein, the terms "liquid-film atomization" and "liquid-film spray" refer to a spray or spray pattern in which atomization occurs by this conventional mechanism. In liquid-film atomization, however, the cohesion and surface tension forces are not entirely overcome and they can profoundly affect the spray, particularly for viscous materials. Conventional airless or pressure spray techniques are known to produce coarser droplets and more nonuniform spray fans as the spray viscosity increases above a relatively low value. This normally limits the usefulness of such spray techniques to spraying liquid fuels, waste materials, and other materials that have very low viscosity. Higher viscosity increases the viscous losses that occur within the spray orifice, which lessens the energy available for atomization, and it decreases shear intensity, which hinders the development of natural instabilities in the expanding liquid film or jet. This delays atomization so that large droplets are formed and the spray becomes nonuniform.

Figure 3A:
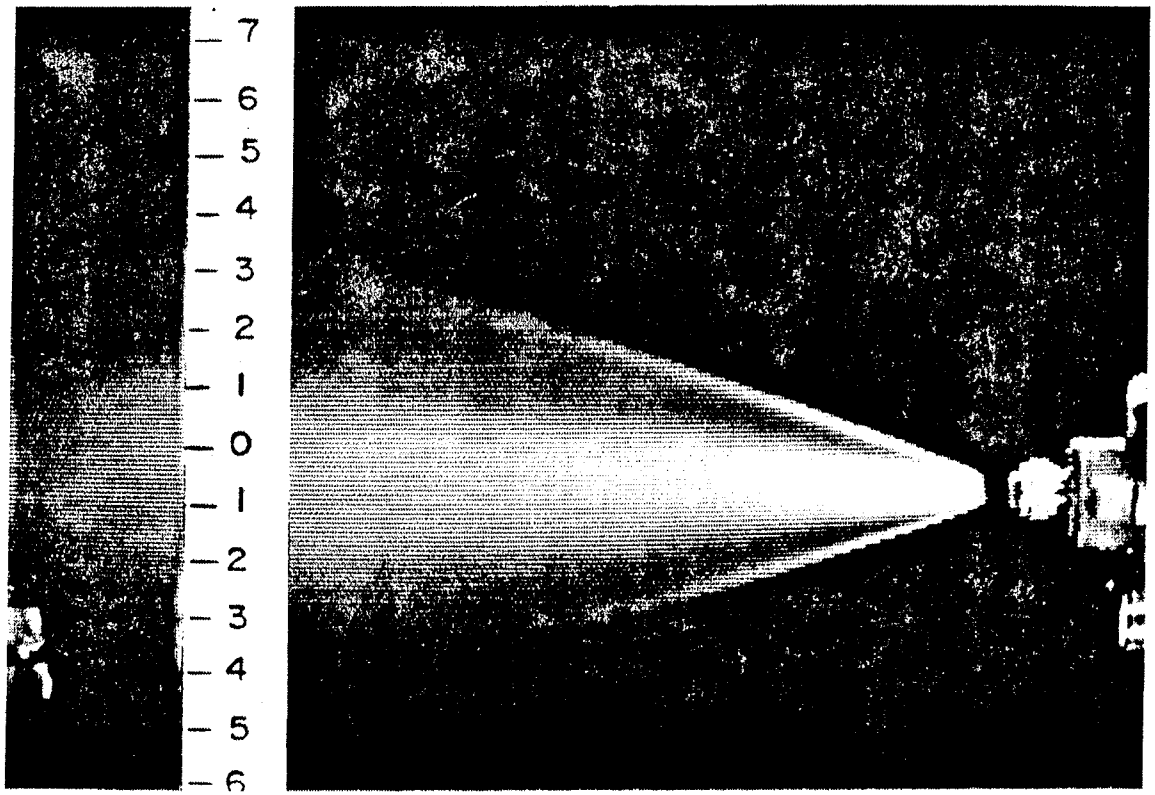
FIGS. 3*a*–3*c* are photoreproductions of actual atomized liquid sprays containing a conventional liquid-film spray pattern produced without supercritical fluid diluent which is not in accordance with the present invention.
Figure 3B:
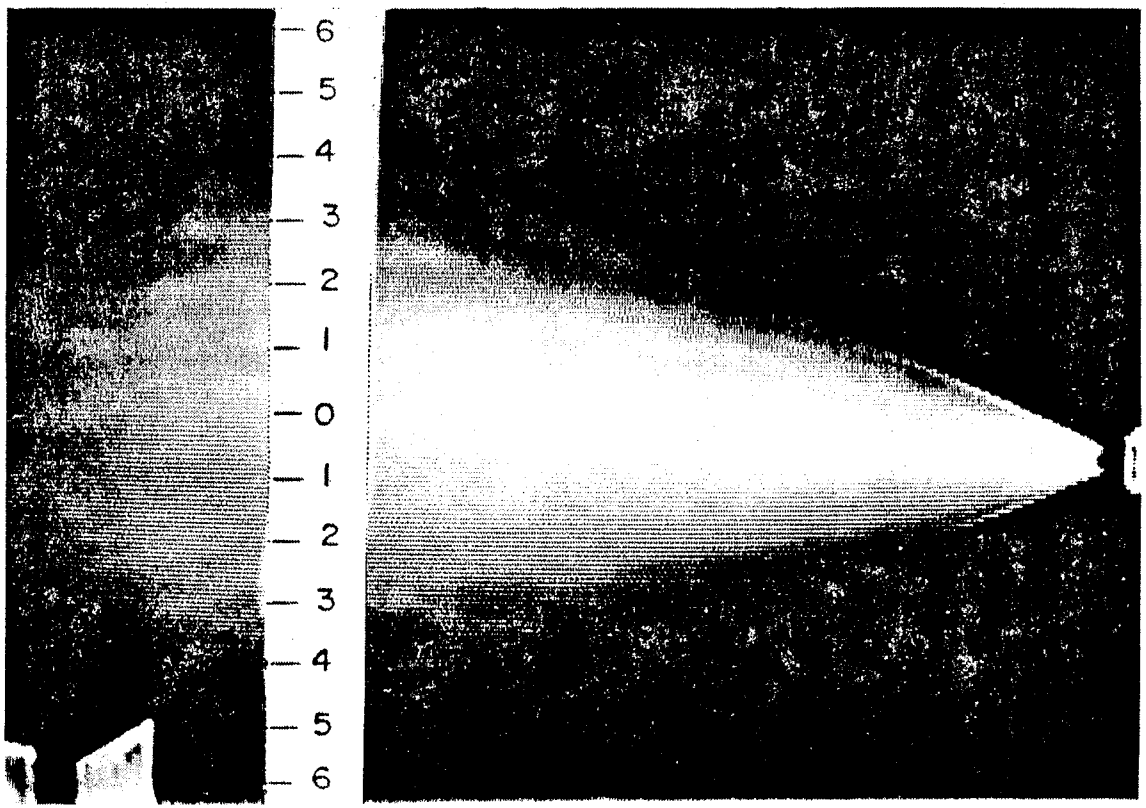
Figure 3C:
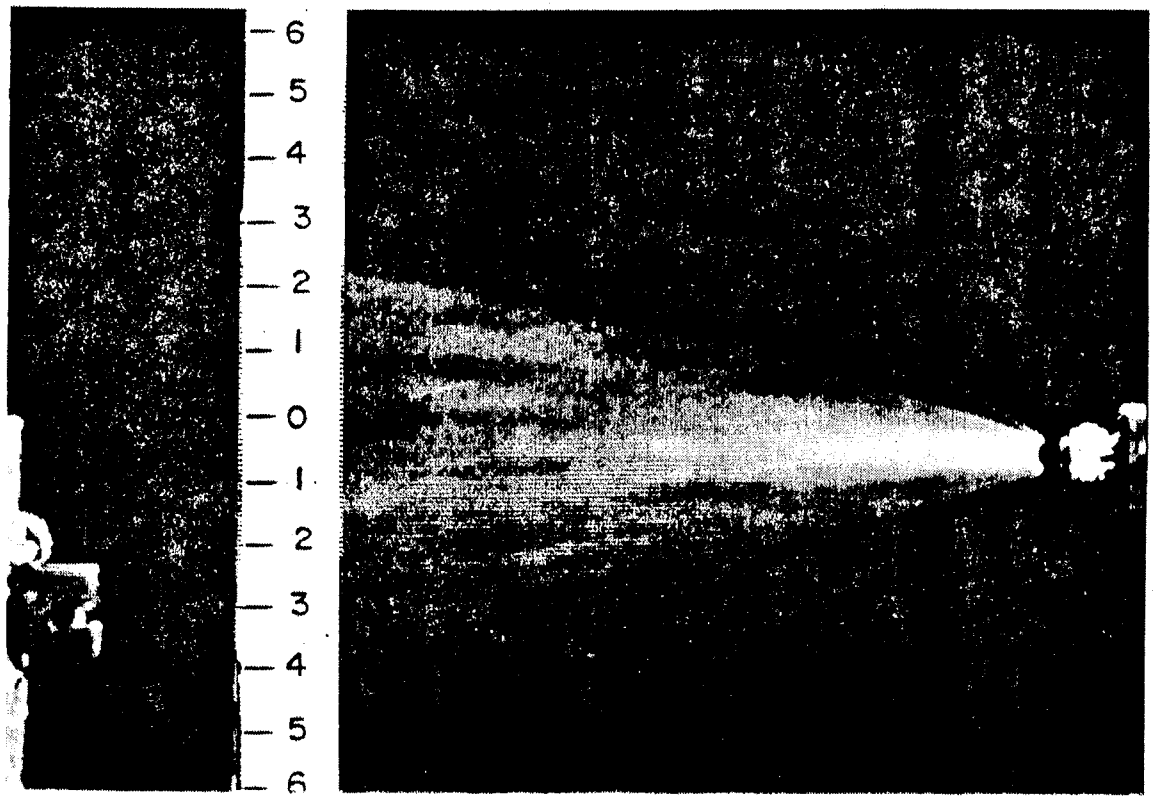

FIGS. 3*a*–3*c* are photoreproductions of actual atomized liquid sprays that illustrate the conventional liquid-film spray pattern produced without supercritical fluid diluent, which are not in accordance with the present invention. The liquid film is visible in FIGS. 3*a*, 3*b*, and 3*c* as the dark space in front of the spray nozzle before atomization occurs and the spray turns white. The sprays have the characteristic angular shape and relatively well defined edge of liquid-film sprays and show non-uniform distribution, particularly in FIGS. 3*a* and 3*c*, where surface tension has gathered material preferentially to the edges of the spray. In FIG. 3*c*, the edges of the spray have separated from the main portion as separate jets of poorly atomized material.

When liquid fuels, waste materials, and other materials are sprayed with supercritical fluids, the large concentration of dissolved supercritical fluid produces a liquid spray mixture with markedly different properties from conventional spray compositions. In particular, the spray mixture becomes highly compressible, that is, the density changes markedly with changes in pressure, whereas conventional spray compositions are incompressible liquids. Without wishing to be bound by theory, it is believed that explosive decompressive atomization can be produced by the dissolved supercritical fluid suddenly becoming exceedingly supersaturated as the compressible spray mixture leaves the nozzle and experiences a sudden and large drop in pressure. This creates a very large driving force for gasification of the dissolved supercritical fluid, which overwhelms the cohesion, surface tension, and viscosity forces that oppose atomization and normally bind the fluid flow together in a liquid-film type of spray. A different atomization mechanism is evident because atomization occurs right at the spray orifice instead of away from it as is the case in conventional sprays. Atomization is believed to be due not to break-up of a liquid film or jet from shear with the surrounding air but instead to the expansive forces of the compressible spray solution created by the large concentration of dissolved supercritical fluid. Therefore, no liquid film is visible coming out of the nozzle. Furthermore, because the spray is no longer bound by cohesion and surface tension forces, it leaves the nozzle at a much wider angle from the centerline than normal airless sprays and produces a uniform spray that is much like those produced by airblast spray techniques. This produces a rounded parabolic-shaped spray instead of the sharp angular sprays typical of conventional airless sprays. The spray also typically has a much greater width than conventional airless sprays produced by the same spray tip. As used herein, the terms "decompressive atomization" and "decompressive spray" refer to a spray or spray pattern that has these characteristics as well as additional characteristics discussed later. Laser light scattering measurements and comparative spray tests show that decompressive atomization can produce fine droplets that are in the same size range as airblast spray systems, instead of the coarser droplets produced by normal airless or pressure sprays. This fine particle size provides ample surface area for the dissolved supercritical fluid to very rapidly diffuse from the droplets within a short distance from the spray orifice.

For a given liquid fuel, waste material, or other material and constant spray temperature and pressure, the decompressive spray pattern is characteristically obtained when the supercritical fluid concentration in the spray mixture exceeds a transition concentration. With no supercritical fluid, the binding forces of cohesion, surface tension, and viscosity in the incompressible spray solution produce a typical liquid-film spray with very poor atomization. At supercritical fluid concentrations below the transition region (from a liquid-film spray to a decompressive spray), the binding force exceeds the expansive force of the supercritical fluid, so a liquid-film spray pattern persists, but it becomes somewhat more uniform, the spray becomes somewhat wider, the visible liquid film recedes towards the orifice, and the spray mixture becomes more compressible as the concentration increases from zero. At the mid-transition concentration in the transition region, the expansive force equals the binding force, so neither controls the spray pattern. The visible liquid film has disappeared and atomization is occurring at the spray orifice. Surprisingly, as the concentration increases and moves through the transition region (from a liquid-film to a decompressive spray) the angular liquid-film spray pattern typically first contracts into a narrow transitional spray and then greatly expands into a much wider, parabolic, decompressive spray pattern produced by explosive decompressive atomization of the highly compressible spray mixture. The transition can be seen not only from changes in the shape of the spray but also in greatly improved atomization. The droplet size becomes much smaller, which shows that the cohesive binding force is completely overcome by the expansive force created by the supercritical fluid. At supercritical fluid concentrations above the transition concentration and outside the transition region, the spray pattern is fully decompressive, much wider, and exits the spray orifice at a much greater angle from the center line. Higher supercritical fluid concentration further decreases the droplet size, further increases the spray width, and makes the spray solution more highly compressible, which affects the spray rate. One manifestation of the expansive force of the supercritical fluid is that the decompressive spray typically has a much greater width than normal airless sprays produced by the same spray tip. Although the spray leaves the spray tip at a much wider angle than normal airless sprays, the spray width can be changed to give spray widths from narrow to very wide by changing the spray width rating of the spray tip. Another manifestation is that the decompressive spray has many of the same characteristics of an airblast spray such as being diffuse and having a feathered, tapered, unconstrained edge, in contrast to typical liquid-film airless sprays, which are generally concentrated and have a well defined edge. This wider, diffuse, feathered spray is beneficial because these characteristics should enhance mixing of combustion air into the spray and thereby promote mixing of oxygen and vaporized fuel, resulting in more efficient combustion with less undesirable combustion byproducts.

FIGS. *2a–2c* are photoreproductions of actual atomized liquid sprays that illustrate decompressive spray patterns produced by dissolved supercritical carbon dioxide in accordance with the present invention. Atomization occurs right at the orifice, as seen by the absence of a visible liquid film and by the large angle from the centerline by which the spray leaves the orifice, which produces the characteristic parabolic shape of the spray. The sprays are diffuse, relatively uniform in the interior, and have feathered, tapered, unconstrained edges in all directions. FIGS. *2a* and *2b* show wide decompressive sprays produced by two different compositions and FIG. *2c* shows a narrower decompressive spray.

For a given liquid fuel or waste material, at a constant concentration of supercritical fluid, a transition from a liquid-film spray to a decompressive spray can frequently be obtained by increasing the spray temperature and/or decreasing the spray pressure. Increasing the temperature increases the driving force for gasification of the supercritical fluid as the spray exits the spray orifice, but it also decreases solubility. Therefore, an optimum temperature usually exists. Decreasing the pressure lowers the density of the compressible spray mixture, which lowers the cohesiveness, but it also decreases solubility. Therefore, an optimum pressure usually exists. In general, the concentration of supercritical fluid, the spray temperature, and the spray pressure needed to obtain a decompressive spray depends upon the properties of the liquid fuel, waste material, or other material being sprayed and is determined experimentally.

Another unique feature of a liquid fuel spray with dissolved supercritical fluid, such as carbon dioxide, is that the supercritical fluid rapidly vaporizes from the spray droplets and spreads out into the spray. That this is not detrimental to combustion efficiency is illustrated by a combustion study that used gaseous carbon dioxide instead of air as an atomization assist gas in the combustion of a petroleum-based oil, a shale-derived oil, and a coal-derived oil. As shown by Siddiqui, et al., 1984, "Emissions of the Oxides of Sulfur and Nitrogen in Synthetic Oil Spray Flames", pages 57–63 in Dicks, J. B., editor, *Tech. Econ. Synfuels Coal Energy Symp.*, ASME, New York, there was no significant alteration of the composition of the flue gas and, therefore, no adverse effects from injecting the carbon dioxide gas into the spray. Although there was some minor changes in the flame temperature profile and the distribution of CO, NO, and sulfur dioxide in the flame, the composition of the flue gases was practically the same.

In the practice of the present invention, liquid spray droplets are produced which generally have an average diameter of one micron or greater. Typically, the droplets have average diameters below about 300 microns. Preferably, the droplets have average diameters below about 100 microns. Most preferably, the droplets have average diameters below about 50 microns. Small spray droplets are desirable for rapid, efficient combustion.

Spray droplet sizes produced by spray mixtures with supercritical carbon dioxide can be illustrated using four viscous organic polymeric compositions that are combustible and which may be used as fuels or could be hazardous waste materials and which are typical of the types of systems suitable in the present invention. Average droplet sizes were measured by laser light scattering using a Malvern 2600 Particle Sizer.

The first composition had an initial viscosity of 670 centipoise at room temperature. It was sprayed at several spray conditions: dissolved supercritical carbon dioxide concentrations of 25 and 30 weight percent, spray temperatures of 40° and 60° C., and spray pressures of 1200 and 1600 psig. A 0.009-inch spray orifice size was used. The measured average droplet sizes are given below.

| Carbon Dioxide | Spray Temperature | Spray Pressure | Droplet Size |
|---|---|---|---|
| 25% | 40° C. | 1200 psig | 132 microns |
| 25% | 40° C. | 1600 psig | 111 microns |
| 25% | 60° C. | 1200 psig | 88 microns |
| 25% | 60° C. | 1600 psig | 120 microns |
| 30% | 40° C. | 1200 psig | 31 microns |
| 30% | 40° C. | 1600 psig | 29 microns |
| 30% | 60° C. | 1200 psig | 34 microns |
| 30% | 60° C. | 1600 psig | 32 microns |

The average droplet size was relatively insensitive to these spray temperatures and pressures but dropped markedly with higher concentration of dissolved supercritical carbon dioxide. The fully decompressive spray with 30% supercritical carbon dioxide produced average fine droplet sizes of about 31 microns, which are highly desirable for efficient combustion.

The second composition had an initial viscosity of 1800 centipoise at room temperature. It was sprayed at a temperature of 55° C., a pressure of 1550 psig, and with the weight percent of dissolved supercritical carbon dioxide increased incrementally from zero. Spray orifice sizes of 0.004, 0.009, and 0.013 inches were used. The measured average droplet sizes (in microns) are given below.

| Carbon | Spray Orifice Size | | |
|---|---|---|---|
| Dioxide | .004-inch | .009-inch | .013-inch |
| 13% | 193 | 206 | 214 |
| 17% | 197 | 203 | 207 |
| 25% | 122 | 172 | 192 |
| 30% | 30 | 34 | 64 |

-continued

| Carbon Dioxide | Spray Orifice Size | | |
|---|---|---|---|
| | .004-inch | .009-inch | .013-inch |
| 35% | 40 | 48 | 62 |

From zero to 10 percent carbon dioxide, sprays with measurable droplet size did not form; the sprays were pencil-size jets. From 13 to 20 percent carbon dioxide, relatively narrow, angular liquid-film sprays were formed, which produced relatively coarse atomization. With about 25 percent carbon dioxide, the sprays were in transition between a liquid-film spray and a decompressive spray. Above about 27 percent carbon dioxide, wide, parabolic, diffuse decompressive sprays were formed, which produced much smaller average droplet sizes that are desirable for efficient combustion. At 35 percent carbon dioxide, the spray mixture was in two-phases, because it contained some carbon dioxide in excess of the solubility limit for these conditions. Excess carbon dioxide can extract volatile components from the liquid phase into the carbon dioxide phase, which can increase the viscosity of the liquid phase. This could explain the apparent increase in droplet size that occurred for the two smaller orifices in going from 30 to 35 percent carbon dioxide.

The third composition contained a dispersion of finely divided solid carbon particles and had a viscosity of about 885 centipoise at room temperature (23° C.). It was sprayed with a 0.009-inch orifice. Over a pressure range of 1250 to 1550 psig, the droplet size was insensitive to spray pressure. Measured average droplet sizes are given below for dissolved supercritical carbon dioxide concentrations of 15 and 20 weight percent and spray temperatures of 40° to 55° C.

| Carbon Dioxide | Spray Temperature | Droplet Size |
|---|---|---|
| 15% | 40° C. | 98 microns |
| 15% | 43° C. | 88 microns |
| 15% | 46° C. | 85 microns |
| 15% | 50° C. | 72 microns |
| 15% | 55° C. | 65 microns |
| 20% | 40° C. | 75 microns |
| 20% | 43° C. | 57 microns |
| 20% | 46° C. | 42 microns |
| 20% | 50° C. | 36 microns |
| 20% | 55° C. | 27 microns |

Average particle size decreased with increasing carbon dioxide concentration and with higher spray temperature, both of which transform the liquid-film spray to a decompressive spray. The decompressive spray produced very fine droplets that are desirable for efficient combustion.

The fourth composition had an initial viscosity of 350 centipoise at room temperature. It was sprayed with a 0.009-inch orifice at a spray temperature of 60° C. and a pressure of 1600 psig. The spray mixture was a single-phase solution that contained 43 weight percent dissolved supercritical carbon dioxide and had a spray viscosity of 1 to 5 centipoise. The decompressive spray produced extremely small droplets having an average droplet size below 10 microns, as evident from the inability of the spray to deposit material on to a substrate.

Supercritical carbon dioxide, nitrous oxide, methane, ethane, and propane are the preferred supercritical fluids in the practice of the present invention due to their low supercritical temperatures and cost. However, any of the aforementioned supercritical fluids and mixtures thereof are to be considered as being applicable for use as diluents with liquid fuels. The miscibility of supercritical carbon dioxide is substantially similar to that of a lower aliphatic hydrocarbon and, as a result, one can consider supercritical carbon dioxide as equivalent to a hydrocarbon diluent such as methane, ethane, or propane, for example. In addition to its miscibility effect, supercritical carbon dioxide could have an environmental benefit by replacing hydrocarbon compounds as a diluent because, being nonflammable, no concern need be given to its complete combustion or the employment of other apparatus to prevent loss of volatile organics to the atmosphere.

Due to the miscibility characteristic of the supercritical fluid with many compounds, a single-phase liquid mixture can be formed that is capable of being sprayed by airless spray techniques. An example is the addition of liquid carbon dioxide to an immiscible mixture of fuel oil and alcohols, such as methanol or ethanol, at subcritical conditions, wherein, when the pressure is then raised to the supercritical pressure of carbon dioxide, complete miscibility occurs resulting in a single phase.

Such a phenomenon is also beneficial when considering the incineration of wastes and other material containing particulate matter. As an example, consider the need to dispose of a hazardous waste that is a highly viscous mixture containing a high molecular weight polymer dissolved in an organic solvent for which spraying into a liquid injection incinerator, the most economical method of disposal, is not practical or even possible. In this case, the addition of additional organic solvent to reduce the viscosity to conditions whereby good atomization can occur may increase costs and may increase the amount of hazardous organic solvent to be so disposed. Using other diluents, which may be cheaper and less of an environmental threat may well cause precipitation of the polymer into particles resulting in a two phase system, which may well be a slime that is not sprayable. The use of carbon dioxide or nitrous oxide, for example, under supercritical conditions as a diluent would not only reduce the viscosity, but more importantly could for many polymer systems present for atomization a single-phase admixture, whereupon spraying into the combustion chamber of the incinerator, droplets of small diameter are attained from which vaporization of the solvent and carbon dioxide leaves small diameter polymer particles of less than say about 10–20 microns to be oxidized, thereby achieving all of the benefits of such combustion conditions.

Another example where supercritical carbon dioxide may be of significance is with carbonaceous material such as coal, wherein, when carbon dioxide is added as a diluent, a major portion of the coal becomes dissolved in the supercritical carbon dioxide, resulting in a solid-liquid two-phase mixture containing, in the solid phase, a much reduced density, increased porosity, and perhaps even a reduced number of smaller solid particles relative to the starting pulverized coal particles, all of which should provide increased fluidity and improved combustion. Upon atomization, such a circumstance allows the formation of smaller diameter droplets resulting in better vaporization and better mixing with air, thereby gaining improved combustion in conventional combustion equipment with only minor, if any, modification.

Supercritical carbon dioxide is a particularly desirable diluent for use in combustion processes because it is formed by combustion of organic materials. Therefore, it is possible to recover the required carbon dioxide from the combustion gases and recycle it as the diluent for viscous fuels or waste materials or to enhance atomization of conventional liquid fuels. Then it need not be supplied as a separate feed material to the combustion process. The carbon dioxide may be separated and recovered from the combustion gases by any of the known methods of recovering carbon dioxide from gas streams as practiced in the chemical industry, such as adsorption, pressure-swing adsorption, parametric pumping, absorption, and reversible chemical complexation. The use and recovery of carbon dioxide is especially appropriate and practical in combustion processes in which the combustion is done in an atmosphere of oxygen and recycled carbon dioxide rather than in air. Instead of feeding air to sustain combustion, pure oxygen is fed instead, thereby eliminating the large concentration of nitrogen in air-feed systems. Therefore, the effluent from the combustion chamber is mainly carbon dioxide, water vapor, and residual oxygen, from which the carbon dioxide is readily recovered. Such processes have already been tested on a commercial scale and shown to be feasible. See Wolsky, A. M., et al., 1990, "Recovering Carbon Dioxide from Large- and Medium-Size Stationary Combustors", Paper No. 90-139.3, 83rd Annual Meeting of the Air & Waste Management Association, Pittsburgh, Pa.

Turning now to how the spray process may be carried out, the liquid spray mixture of supercritical fluid and liquid fuel or waste material is sprayed by passing it under pressure through a spray orifice into a combustion zone, where it is mixed with oxygen or air and heated to produce combustion of the finely atomized fuel or waste material.

As used herein, an orifice is a hole or an opening in a wall or housing, such as in a spray tip or spray nozzle of a burner, injector, or other spray device. The liquid spray mixture flows through the orifice from a region of higher pressure, such as inside the burner spray tip or nozzle, into a region of lower pressure, such as the combustion zone, which is generally at or near atmospheric pressure. An orifice may also be a hole or an opening in the wall of a pressurized vessel, such as a tank or cylinder. An orifice may also be the open end of a tube or pipe or conduit through which the mixture is discharged. The open end of the tube or pipe or conduit may be constricted or partially blocked to reduce the open flow area.

Spray orifices, spray tips, and spray nozzles used in burner assemblies for airless and air-assisted airless spraying of liquid fuels under high pressure are suitable for spraying liquid fuels and waste materials with supercritical fluids. The spray tips, nozzles, and burner assemblies must be built to safely contain the spray pressure used. The outlet from the spray orifice is preferably constructed free of obstructions in the immediate vicinity that could be struck by the wide explosive decompressive spray produced by the supercritical fluid, which generally exits the spray orifice at a large angle from the center line.

The material of construction of the orifice is not critical in the practice of the present invention, provided the material possesses necessary mechanical strength for the high spray pressure used, has sufficient abrasion resistance to resist wear from fluid flow, is inert to the fuels and waste materials with which it comes into contact, and is not degraded by exposure to the high combustion temperature produced in the combustion zone. Any of the materials used in the construction of airless spray tips, such as boron carbide, titanium carbide, ceramic, stainless steel or brass, is suitable, with tungsten carbide generally being preferred.

The orifice sizes suitable for the practice of the present invention generally range from about 0.004-inch to about 0.050-inch diameter. Because the orifices are sometimes not circular, the diameters referred to are equivalent to a circular diameter. The proper selection is determined by the orifice size that will supply the desired flow rate of liquid fuel or waste material to the combustion zone for the particular combustion application. Typically the flow rate through the orifice increases linearly with the nominal cross-sectional area of the orifice. Generally smaller orifices are desired at lower viscosity and larger orifices are desired at higher viscosity. Smaller orifices give finer atomization but lower output. Larger orifices give higher output but poorer atomization. Finer atomization is preferred in the practice of the present invention. Therefore small orifice sizes from about 0.004-inch to about 0.025-inch diameter are preferred. Orifice sizes from about 0.007-inch to about 0.015-inch diameter are most preferred. However, for spray mixtures that contain dispersed solid particulates, larger spray orifices sizes may be desirable to prevent plugging if the particulates have appreciable size. For achieving very high combustion rates, the use of multiple orifices at different locations in the combustion zone is usually preferred to using a single very large orifice size.

Spray flow rates produced by a spray mixture that contains supercritical carbon dioxide can be illustrated using a viscous organic polymeric composition that could be a fuel or a waste material. The composition had a viscosity of 670 centipoise at room temperature. The liquid spray mixture contained 30 weight percent dissolved supercritical carbon dioxide and was sprayed at a temperature of 50° C. and a pressure of 1500 psi. The spray viscosity was 7 to 10 centipoise. Typical spray flow rates are given below (not including the carbon dioxide) for a range of spray orifice size.

| Orifice Size | Spray Flow Rate |
|---|---|
| .007 inch | 112 grams/minute |
| .009 inch | 154 grams/minute |
| .011 inch | 214 grams/minute |
| .013 inch | 287 grams/minute |

These flow rates fall well within the design capacity range of 30 to 600 grams/minute for conventional burner nozzles that use distillate fuels with a moderate viscosity of about 30 centipoise.

Devices and flow designs that promote turbulent, agitated, or swirl flow of the liquid spray mixture may also be used in the practice of the present invention. Such techniques include but are not limited to the use of pre-orifices, diffusers, turbulence plates, restrictors, flow splitters/combiners, flow impingers, screens, baffles, vanes, and other devices that are commonly used in pressure atomizers and airless spray processes.

Filtering the liquid spray mixture prior to flow through the orifice is desirable to remove large particulates that might plug the orifice. This can be done using conventional high-pressure filters. The flow passages in the filter should be smaller than the spray orifice size.

The spray pressure used in the practice of the present invention is a function of the properties of the liquid fuel or waste material, the supercritical fluid being used, and the viscosity of the liquid spray mixture. The minimum spray pressure is at or slightly below the critical pressure of the supercritical fluid. Generally the pressure will be below 5000 psi. Preferably the spray pressure is above the critical pressure of the supercritical fluid and below 3000 psi. If the supercritical fluid is supercritical carbon dioxide, the preferred spray pressure is between 1070 psi and 3000 psi. The most preferred spray pressure is between 1200 psi and 2500 psi.

Generally, solubility of the supercritical fluid in the liquid fuel or waste material increases at higher pressure, but excessively high pressure can cause poor dispersion of the spray. The spray pressure is usually adjusted to give the desired spray characteristics and the spray orifice size adjusted to give the desired spray flow rate.

The spray temperature used in the practice of the present invention is a function of the properties of the liquid fuel or waste material, the supercritical fluid being used, and the concentration of supercritical fluid in the liquid spray mixture. The minimum spray temperature is at or slightly below the critical temperature of the supercritical fluid. The maximum spray temperature is below the critical temperature of the liquid fuel or waste material. Heating the spray mixture to above the critical temperature of the supercritical fluid is desirable to produce more explosive atomization, but excessively high temperature can significantly reduce solubility of the supercritical fluid in the liquid fuel or waste material.

If the supercritical fluid is supercritical carbon dioxide, the minimum spray temperature is about 25° C. The maximum temperature is below the critical temperature of the liquid fuel or waste material. The preferred spray temperature is between 35° and 90° C. The most preferred temperature is between 40° and 75° C.

The environment of the combustion zone into which the liquid fuel or waste material is sprayed in the present invention is not narrowly critical. The combustion zone must be supplied with proper flow of oxygen to provide for proper combustion of the liquid fuel or waste material, as is known to those skilled in the art of combustion. However, the pressure therein must be much less than that required to maintain the supercritical fluid component of the liquid spray mixture in the supercritical state. Preferably, the pressure in the combustion zone is below about 200 psi, so that it is low compared to the spray pressure in order to promote vigorous atomization by the supercritical fluid. Most preferably, the pressure in the combustion zone is at or near atmospheric pressure, so that 1) the most vigorous atomization is obtained, 2) the combustion zone apparatus need not be built to withstand an elevated pressure, and 3) the combustion air need not be compressed and pressurized to an elevated pressure, which would increase cost and energy consumption. Generally air will be supplied to support combustion, but oxygen may be also supplied in the form of oxygen-enriched air or as pure oxygen. For some applications, oxygen may be preferred.

The present invention may utilize compressed gas to assist formation of the liquid spray, to modify its shape, to assist dispersion of the spray in the combustion zone, and/or to assist combustion of the spray. For combustion at or near atmospheric pressure, the assist gas is typically compressed air at pressures from 5 to 80 psi, but may also be compressed oxygen-enriched air, oxygen, or a gaseous fuel such as methane. The assist gas may be directed into the liquid spray as one or more high-velocity jets of gas. The assist gas may be heated. The flow rate of the assist air or oxygen must be balanced with the overall feed rate of air or oxygen to provide the proper ratio of oxygen to fuel for proper combustion, as is known to those skilled in the art of combustion.

Figure 4:
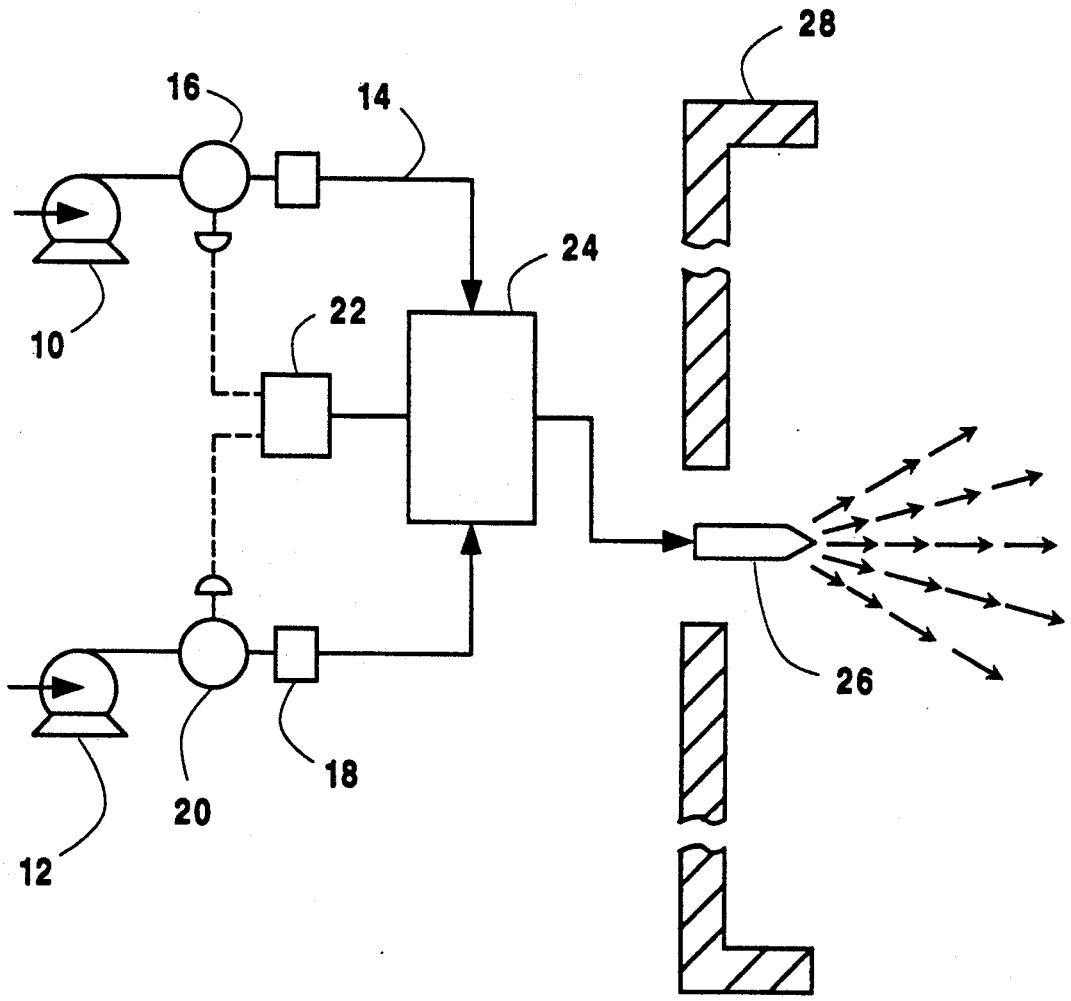
FIG. 4 is a schematic diagram of the present invention showing the basic elements in which a mixture of supercritical fluid and fuel are prepared for atomization and burning.

Referring now to FIG. 4, an apparatus is shown that is capable of pressurizing, metering, proportioning, heating, and mixing a liquid fuel or waste composition with a supercritical fluid diluent to form a spray mixture that is sprayed under the supercritical conditions of the diluent into a combustion zone or chamber. While this discussion is specifically focused on liquid fuels, it is in no way limited to these materials. Any admixture of fuels, solvents, additives such as water, and supercritical fluid diluents may be prepared with the apparatus and methods of the present invention as one of its embodiments, including any diluent capable of entering its supercritical state such as the ones aforementioned, but not limited to the preferred ones of carbon dioxide, nitrous oxide, methane, ethane, propane, and butane. Likewise, while the discussion is also focused on an airless or pressure atomizer, it is in no way limited to this type. Any atomizing burner such as a high-pressure steam atomizer, an air-assisted airless atomizer, and a low-pressure-air atomizing burner with the fuel-diluent admixture applied under supercritical conditions, may also be utilized.

In particular, the system includes a high pressure fuel pump (10) and a high pressure diluent pump (12). Fuel pump (10) receives the liquid fuel, as a liquid at suitable conditions of temperature and viscosity, from any suitable source, such as a tank (not shown), and pumps and pressurizes the fuel to the desired spray pressure. Pump (12) receives the supercritical fluid diluent, preferable as a liquid supplied at its vapor pressure, from any suitable source, such as a pressurized cylinder or tank (not shown), and pumps and pressurizes the diluent to the desired spray pressure. Pump (12) may also be a gas compressor or a gas booster pump in accordance with the properties of the diluent used. Pumps (10) and (12) may contain more than one pumping stage or may be a combination of more than one pump, such as a booster pump located at the feed source followed by a pressurizing pump located at the mixing unit.

The fuel from pump (10) and the diluent from pump (12) flow to a mixing/heating chamber (24) wherein they are mixed and heated to the desired spray temperature. The heating may be done by any suitable means, such as a high-pressure electrical heater or by a heat exchanger that utilizes heat derived from the combustion. The amount of fuel received from pump (10) is measured by fuel flowmeter (14) and controlled by control valve (16). Likewise the amount of diluent fluid received from pump (12) is measured by diluent flowmeter (18) and controlled by control valve (20). The proportion of diluent to fuel is controlled by electronic ratio controller (22), which receives electronic signal input from flowmeters (14) and (18) and sends electronic signal output to control valves (16) and (20).

The liquid spray mixture of fuel and supercritical fluid diluent from mixing/heating chamber (24) is passed through an orifice in a suitable high-pressure airless atomizing burner nozzle (26) into a combustion zone which may be a conventional combustion chamber (28) wherein combustion of the sprayed fuel occurs. Upon release from burner nozzle (26), the supercritical fluid atomizes and disperses the fuel throughout the combustion zone in combustion chamber (28).

In operation, No. 6 fuel oil, in this example, is supplied from a suitable source at a temperature of about 30° C., which provides the fuel at a viscosity of about 2000 centipoise to pump (10), where the pressure is increased to a spray pressure of about 1500 psi as the fuel flows to mixing/heating chamber (24), with the rate of flow measured by flowmeter (14) and maintained by control valve (16), which is positioned appropriately by an electric signal from electronic ratio controller (22), based on a preset value initialized in controller (22).

The diluent fluid, ethane from natural gas in this example, is supplied from a suitable source at its vapor pressure at an ambient temperature of 25° C. to pump (12), where the pressure is increased to the spray pressure of about 1500 psi as the ethane flows to mixing-/heating chamber (24), with the rate of ethane flow maintained by control valve (20), which is positioned by an electric signal from electronic ratio controller (22) that is set to give about 30 weight percent ethane in the spray mixture of fuel oil and supercritical ethane, with the ethane flow rate measured by flowmeter (18).

The two fluids are completely mixed by a suitable mixing device (not shown), such as a static mixer, in mixer/heater (24), and form one phase as the mixing occurs under heating by a suitable heating device (not shown) to a spray temperature of about 50° C.

In this example, for simplicity, it is assumed that the pressure in mixer/heater (24) is approximately equal to the fluid outlet pressure of pumps (10) and (12), that is, little pressure drop occurs as the fuel and diluent flow from the pumps to atomizing burner nozzle (26), wherefrom the mixture is emitted as a spray of finely dispersed droplets into the combustion zone in combustion chamber (28), wherein it is burned.

It will be appreciated that although the drawing shows a single atomizing nozzle (26), a plurality of nozzles can be used to inject the fuel-supercritical fluid diluent liquid mixture into combustion chamber (28).

In an embodiment of the apparatus and method presented in FIG. 4, optional in-line static mixer(s) means, or other mixing means, an optional filter, and in-line heater(s) means may be provided in the conduit communicating mixing chamber (24) with burner nozzle (26).

In another embodiment of the present invention, additional fluids and additives can be added to mixing chamber (24) using suitable sources, pumps, and metering and control means. Such fluids may include, but not be limited to, solvents, combustion additives such as catalysts and promoters, air or oxygen (under conditions wherein premature combustion does not pose a hazard, such as with high-flash-point materials), and water, if desired.

The apparatus preferably also has appropriate safety devices such as pressure relief valves or rupture disks to prevent overpressurization of the high pressure portions, such as at the outlets from the pumps. Heated lines are also preferably insulated to prevent undesirable heat loss that could lower the temperature below the desired spray temperature.

In the preferred embodiment, the output of combustion is applied to apparatus wherein the useful conversion of the combustion energy is accomplished. However, it will be understood that the invention is applicable to any device wherein almost instantaneous vaporization and mixing of the fuel with the surrounding gas is required or desirable.

It is also to be understood that the individual components of the method and apparatus of this invention may be selected from commercially available standard equipment provided said items are capable of achieving the desired results. As such, said individual components are not essential to the extent and intent of the invention.

Figure 5:
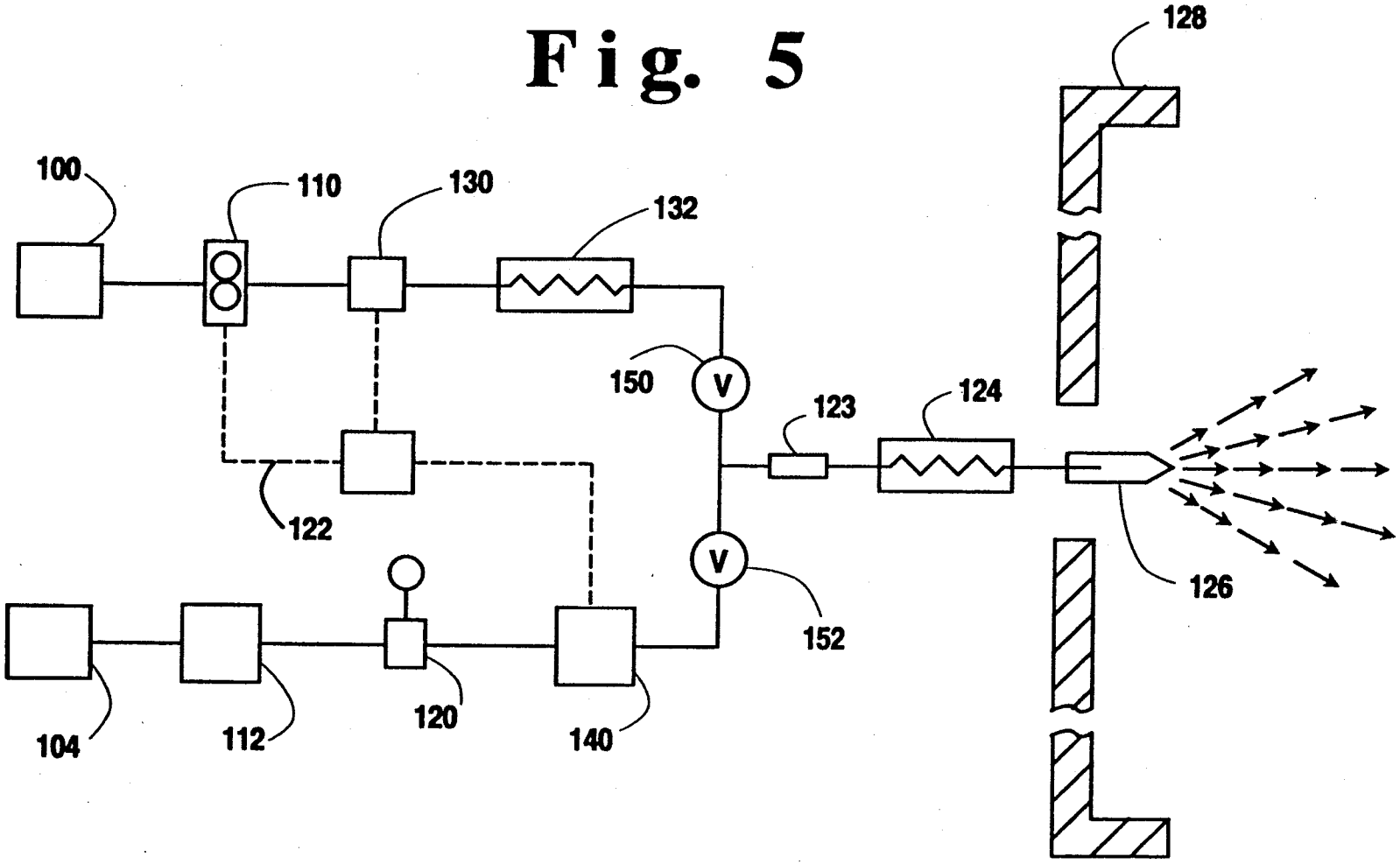
FIG. 5 is a schematic diagram of yet another spray apparatus embodiment of the present invention.

FIG. 5 is a schematic diagram of yet another spray apparatus in which the present invention may be carried out, and which is a more preferred embodiment. The apparatus is particularly suited to metering a compressible diluent fluid with incompressible liquid fuel or waste material. Specifically, the mass flow rate of the compressible supercritical fluid diluent is continuously and instantaneously measured by a mass flow meter and fed to a signal processor, which controls a metering pump that continuously and instantaneously meters in the desired proportion of fuel or waste material. The diluent is supplied upon demand, preferably as a liquid, from a diluent feed system, shown generally as (104) in the diagram. The feed system may be a liquified compressed gas cylinder at ambient temperature, a refrigerated liquified compressed gas cylinder or tank, or a pipeline. The feed system preferably includes an air-driven primer or booster pump (not shown), such as Haskel Inc. model AGD-15, to supply the diluent at a pressure above its ambient vapor pressure for distribution to the spray apparatus, in order to suppress cavitation. The diluent is fed from supply system (104) to an air-driven primary pump (112), such as Haskel Inc. model DSF-35, located at the spray apparatus. Primary pump (112) pressurizes the diluent to about 200 to 300 psi above the spray pressure. The primer pump and primary pump (112) are driven by air motors (not shown) that are supplied with compressed air on demand through pressure regulators (not shown) set to give the proper air pressures required for the desired pumping pressures. Pump (112) is designed for pumping liquified gases under pressure without requiring refrigeration to avoid cavitation. The pressurized diluent is then regulated with pressure regulator (120), such as Scott high pressure regulator model 51-08-CS, to a steady outlet pressure that is set to the desired spray pressure. Pressure regulator (120) allows diluent to flow in response to any fall off in downstream pressure that occurs during spraying. When not spraying, the outlet pressure at pump (112) equalizes to the pressure at the regulator inlet and the pump stalls. A coriolis mass flow meter (140), such as Micro Motion model D6, measures the true mass flow rate of the diluent. The diluent flows through check valve (152) to the mix point with the liquid fuel or waste material. The liquid fuel or waste material, hereafter referred to as the fuel in this discussion, is supplied on demand from a fuel feed system, shown generally as (100) in the drawing. It may be a tank and may include a primer or booster pump, which is desirable for fuels of relatively low viscosity, and provision for preheating viscous fuels for distribution, if necessary. The fuel is metered and pressurized to spray pressure by a precision metering pump (110), such as a metering gear pump, such as Zenith model HMB-5740, at the proper flow rate in response to the measured mass flow rate of the diluent. The mass flow meter (140) measures the diluent mass flow rate and sends a signal from its electronic transducer (not shown), such as Micro Motion electronic module, to the metering pump electronic ratio controller (122), such as Zenith Metering/Control System model QM1726E, that controls the operating speed of metering pump (110). The fuel flow rate produced by metering pump (110) is measured by a precision flow meter (130), such as a gear flow meter, such as AW Company model ZHM-02, to monitor the delivered flow rate and to provide feedback control to the metering pump controller (122). By using this feed back control, pumping inefficiency in metering pump (110), such as caused by slippage, wear, or plugging by solids, is automatically corrected for and the desired flow rate is obtained regardless of change in viscosity or pumping pressure. The fuel is optionally preheated in high-pressure heater (132), such as Binks electric heater model 42-6401, to reduce its viscosity before flowing through check valve (150) to the mix point with the diluent. From the mix point, the admixed fuel and diluent flow through static mixer (123), such as a Kenics mixer, to high-pressure heater (124), such as Binks electric heater model 42-6401, which heats the spray mixture to the desired spray temperature and converts the diluent to a supercritical fluid diluent. The spray mixture, which contains the desired concentration of supercritical fluid diluent and which is at the desired spray temperature and pressure, is sprayed by atomizing burner nozzle (126), wherefrom the mixture is emitted as a spray of finely dispersed droplets into the combustion zone in combustion chamber 128, wherein it is burned. Preferably the spray system has a valve (not shown) located just before burner nozzle (126) to turn the spray on and off.

In operation, for example, carbon dioxide diluent is supplied from a carbon dioxide supply system (104), which may be a liquified compressed gas cylinder at ambient temperature and a vapor pressure of about 830 psig or may be a refrigerated cylinder or tank at a temperature of about −15° C. and a vapor pressure of about 300 psig. The carbon dioxide is pressurized by a booster pump, located at the supply system, to a pressure of 1000 psig and pressurized by primary pump (112) to 1800 psig. The carbon dioxide pressure is reduced by pressure regulator (120) to the desired spray pressure of 1500 psig and the mass flow rate is measured by mass flow meter (140) during spraying. A viscous fuel is supplied from fuel supply system (100) to metering pump (110), which pumps the fuel at the proper flow rate in response to the measured mass flow rate of the carbon dioxide to give a constant carbon dioxide concentration of 30 weight percent. The fuel flow rate is measured and verified by flow meter (130) and preheated in heater (132) to about 40° C. to reduce its viscosity for mixing with the carbon dioxide at the mix point between check valves (150) and (152). The mixture of fuel and carbon dioxide are mixed in static mixer (123), heated in heater (124) to the spray temperature of 50° C., and sprayed by burner nozzle (126) to form a decompressive spray of fine droplets in combustion chamber (128), wherein it is burned.

While preferred forms of the present invention have been described, it should be apparent to those skilled in the art that methods and apparatus may be employed that are different from those shown without departing from the spirit and scope thereof.

What is claimed is:

1. A process for forming a combustible liquid spray mixture which comprises:

a) forming a liquid mixture in a closed system, said liquid mixture comprising:

(i) at least one liquid fuel capable of being combusted; and (ii) at least one supercritical fluid selected from the group consisting of carbon dioxide, nitrous oxide, sulfur dioxide, ammonia, methyl amines, xenon, krypton, methane, ethane, ethylene, propane, propylene, butane, butene, pentane, diemthyl ether, methyl ethyl ether, diethyl ether, formaldehyde, chlorotrifluoromethane, monofluoromethane, methyl chloride, cyclopentane, and mixtures thereof, which is at least partially miscible with the liquid fuel; and b) spraying said liquid mixture into an atmosphere capable of sustaining combustion of said liquid fuel.

2. The process of claim 1, wherein the at least one supercritical fluid is added in an amount sufficient to render the viscosity of the liquid mixture to a point suitable for spray combustion.

3. The process of claim 2, wherein the amount of supercritical fluid in the liquid mixture ranges from about 10 to about 60 weight percent based upon the total weight of the liquid mixture.

4. The process of claim 1, wherein the liquid fuel is a petroleum product.

5. The process of claim 1, wherein the liquid fuel contains solid particulate combustible matter.

6. The process of claim 5, wherein the solid particulate combustible matter is coal.

7. The process of claim 1, wherein the liquid fuel is a liquid organic waste material.

8. The process of claim 1, wherein the at least one supercritical fluid is supercritical carbon dioxide.

9. The process of claim 8, wherein at least a portion of the supercritical carbon dioxide is carbon dioxide recovered from the combustion of said liquid fuel.

10. The process of claim 1, wherein the liquid mixture is sprayed into an atmosphere comprising air at or near atmospheric pressure.

11. The process of claim 1 further comprising heating the liquid mixture prior to spraying.

12. The process of claim 1, wherein the liquid mixture is sprayed as a decompressive spray.

13. The process of claim 12, wherein the liquid fuel contains solid particulate combustible matter.

14. The process of claim 13, wherein the solid particulate combustible matter is coal.

15. The process of claim 12, wherein the liquid fuel is a liquid organic waste material.

16. The process of claim 12, wherein the at least one supercritical fluid is supercritical carbon dioxide.

17. The process of claim 12, wherein at least a portion of the supercritical carbon dioxide is carbon dioxide recovered from combustion of said liquid fuel.

18. The process of claim 12 further comprising heating the liquid mixture prior to spraying.

19. An apparatus for the spray combustion of liquid fuels containing at least one supercritical fluid comprising, in combination:

a) means for supplying at least one liquid fuel capable of being combusted;

b) means for supplying at least one supercritical fluid;

c) means for forming a liquid mixture of the components supplied by means (a) and (b);

d) means for spraying said liquid mixture by passing the mixture under pressure through an orifice into an atmosphere capable of sustaining combustion; and e) means to heat the liquid mixture prior to being passed to the spraying means.

* * * * *